US008544696B2

(12) United States Patent
Willemsen et al.

(10) Patent No.: US 8,544,696 B2
(45) Date of Patent: Oct. 1, 2013

(54) AEROSOL CONTAINER AND DISPENSER MACHINE

(75) Inventors: Robert Willemsen, Huizen (NL); Roeland Petrus Maria van Oirschot, Leusden (NL); Sjoerd Ruarus, 'S-Graveland (NL)

(73) Assignee: Dreumex B.V., Oss (NL)

( * ) Notice: Subject to any disclaimer, the term of this patent is extended or adjusted under 35 U.S.C. 154(b) by 201 days.

(21) Appl. No.: 13/101,337

(22) Filed: May 5, 2011

(65) Prior Publication Data

US 2012/0043349 A1 Feb. 23, 2012

(30) Foreign Application Priority Data

May 6, 2010 (NL) ..... 2004674

(51) Int. Cl.
*B67D 7/06* (2010.01)

(52) U.S. Cl.
USPC ..... 222/181.3; 222/402.1; 222/504; 222/153.13

(58) Field of Classification Search
USPC ..... 222/402.1, 504, 181.3, 321.6, 523, 222/524, 525, 63, 153.13, 505, 509
See application file for complete search history.

(56) References Cited

U.S. PATENT DOCUMENTS

| | | | | |
|---|---|---|---|---|
| 3,165,238 | A * | 1/1965 | Wiley | 222/645 |
| 3,179,296 | A | 4/1965 | Cairelli | |
| 3,331,534 | A * | 7/1967 | Brown | 222/647 |
| 3,361,301 | A | 1/1968 | Meshberg | |
| 3,841,525 | A * | 10/1974 | Siegel | 222/649 |
| 4,570,824 | A * | 2/1986 | Bolling | 222/39 |
| 5,098,291 | A * | 3/1992 | Curtis et al. | 433/89 |
| 6,607,103 | B2 * | 8/2003 | Gerenraich et al. | 222/183 |
| 6,820,777 | B2 * | 11/2004 | Frutin | 222/402.15 |
| 8,025,189 | B2 * | 9/2011 | Salameh | 222/402.1 |
| 8,342,365 | B2 * | 1/2013 | Snodgrass | 222/63 |
| 2004/0251271 | A1 * | 12/2004 | Jackson et al. | 222/63 |
| 2008/0023497 | A1 | 1/2008 | Sassoon | |
| 2009/0045219 | A1 * | 2/2009 | Helf et al. | 222/52 |
| 2010/0237106 | A1 | 9/2010 | Wolf et al. | |
| 2011/0127290 | A1 * | 6/2011 | Law et al. | 222/1 |

FOREIGN PATENT DOCUMENTS

| | | |
|---|---|---|
| CH | 561381 | 4/1975 |
| DE | 102007049334 | 4/2009 |
| EP | 1422167 | 5/2004 |
| EP | 1695720 | 8/2006 |

OTHER PUBLICATIONS

Search Report for NL 2004674 dated Dec. 17, 2010.

* cited by examiner

*Primary Examiner* — Paul R Durand
*Assistant Examiner* — Donnell Long
(74) *Attorney, Agent, or Firm* — Thomas|Horstemeyer, LLP

(57) ABSTRACT

Aerosol container for use in a dispenser machine. The aerosol container comprises a container body comprising an exhaust opening provided with a valve. The aerosol container further comprises a spout having a spout housing. The spout housing is fixed to the container body. The spout housing circumferences the valve. The spout comprises an inner actuating mechanism for actuating the valve to an open position. The mechanism comprises a drive member to be driven by a drive component of the dispenser machine and an actuator member to act the valve to said open position. The aerosol container has a simple and compact configuration. The provided aerosol container and dispenser machine provide a system in particular suitable for public and working environments, like factories.

20 Claims, 19 Drawing Sheets

AEROSOL CONTAINER AND DISPENSER MACHINE

This application claims the benefit of and priority to The Netherlands patent application number 2004674, filed May 6, 2010, which is incorporated by reference in its entirety as if fully set forth herein.

FIELD OF THE INVENTION

The present invention relates to an aerosol container. The invention relates preferably to a soap aerosol container, more preferably to a foaming soap aerosol container. The aerosol container has a container body and a spout. Further, the invention relates to a dispenser machine for use in combination with the aerosol container.

BACKGROUND

A dispenser machine to be used with an aerosol container is disclosed in EP1.695.720. The disclosure relates to an automatic air freshener comprising an upright base for mounting on a vertical wall and having upper and lower housings to receive an aerosol can containing a supply of fragrance for discharge in a spray or jet from the can. The upper housing has a battery powered mechanism for causing the aerosol to be discharged periodically and the lower housing has a control panel and a display screen. At the upper end of the can there is a spray head mounted on a plunger of the valve for operating the aerosol and provided with a horizontally acting jet nozzle for delivering a spray of fragrance horizontally from the head when the head is displaced downwardly against the powerful action of a return spring in the can to trigger opening of the valve of the aerosol. Depressing the spray head causes a predetermined quantity of fragrance to be dispersed.

The known dispenser machine uses a common aerosol container with a commonly known spray head. The common aerosol container with spray head can be used in combination with a lot of other devices but can also be used stand alone and manually operated.

The fact that the aerosol container can be emptied easily without using the dispenser machine is problematic. Someone only needs to depress the spray head which will discharge product from the aerosol container. For this reason the aerosol container and corresponding dispenser machine is less suitable to be installed at public spaces. Misuse of the aerosol container is badly protected. Product can easily be spoiled at the public place. In particular, when the product is soap, vandals may change a public space into a wet sticky environment.

In particular, the dispenser machine does not satisfy to given requirements to install the dispenser machine at public places. To be installed at public places, the dispenser machine needs to be vandalism proof. It is an existing problem that aerosol containers are stolen from public places for use at home.

DE 10.2007.049.334 discloses an aerosol container. The aerosol container is designed as a stand alone aerosol container. The aerosol container includes a cam profile inside a spout housing to operate a valve of a container body. The aerosol container has a lever which is connected with the cam profile. The lever extends out of the spout housing and suits a manual operation. The lever may be pivoted to press the cam profile downwards over an adjustable travel distance. The cam profile is rotatable connected to the spout housing to adjust this travel distance.

A drawback of this aerosol container is that the aerosol container has a lever which has to be operated by hand. In case that the aerosol container is a foam aerosol container, the operation by dirty hands will at least contaminate the lever. In addition, the aerosol container can be emptied easily without dispenser machine which make the aerosol dispenser vulnerable for misuse and vandalism. It is an object of the present invention to at least partially eliminate the above mentioned drawbacks and/or to provide a useable alternative. In particular, it is an object of the invention to provide a vandalism proof aerosol container and dispenser machine.

SUMMARY

This object is achieved by an aerosol container as disclosed herein. According to the invention, an aerosol container is provided for use in a dispenser machine. The aerosol container comprises a container body for containing a product and a propellant. The propellant may be DME which is dimethyl ether. The propellant may be dissolved in the product. Preferably, the container body is filled with product. The container body may be a so called bag on valve aerosol. The container body of a bag on valve aerosol comprises a bag which may be filled with product and pressurized air as a propellant. The container body has a bottom end, a cylindrical wall which defines an axial direction and a top end. The top end comprises an opening provided with a valve, in particular a stem valve. The stem valve includes a hollow stem for discharging product from the container body. The valve is actuable to an open position and normally closed in a closed position.

The aerosol container according to the invention further comprises a spout having a spout housing. The spout housing is fixed to the container body. The aerosol container with container body and spout is a disposable aerosol container. The spout housing circumferences the valve. The spout housing has an outer wall and an outlet opening which is in fluid communication with the opening of the container body for discharging product from the aerosol container. The spout comprises an inner actuating mechanism for actuating the valve to said open position. The valve may be actuated by tilting or axially moving the hollow stem. The inner actuating mechanism comprises an actuator member to act on the valve to act the valve to said open position. The actuator member comprises a cam profile which is connected to the valve such that an axial movement of the cam profile causes an axial movement of the hollow stem to open or close the valve.

The aerosol container is improved in that the cam profile is connected to the spout housing by at least one lock member to prevent a rotation of the cam profile with respect to the spout housing and to permit an axial movement of the cam profile with respect to the spout housing. Advantageously, the rotational lockage of the cam profile with respect to the spout housing allows a rotational actuation about an axial axis to move the actuator member in axial direction. The at least one lock member prevents that the cam profile of the spout rotates together with a rotating enganging element, which may comprise a cam profile in mirrored orientation. This engaging rotational cam profile is in this application indicated as a first cam profile and the cam profile which is blocked in rotation and connected to the spout housing is indicated as a second cam profile. Advantageously, the arrangement of the actuator member including the cam profile allows a compact configuration of the actuator mechanism.

In an embodiment of the aerosol container, the cam profile has an at least two fold rotational symmetry. Particularly, the cam profile comprises a cam surface which has at least two depressions and at least two elevations in axial direction. The cam profile may comprise a cylindrical body including a central axis which extends in the axial direction of the container body. The at least two elevations are positioned opposite each other with respect to the central axis through the cylindrical body. The rotational symmetry may prevent a tilting movement of the valve. The rotational symmetry of the cam profile causes a more pure axial movement of the valve which may advantageously provide a better control of dispensing of product.

In an embodiment of the aerosol container, the at least one lock member has a ring body which circumferences the cam profile of the actuator body. The at least one lock member is ring shaped. The ring body is fixed to the outer wall of the spout housing at two opposite positioned outer fixation points and fixed to the actuator member (59) by two opposite positioned inner fixation points. Advantageously, the ring shaped lock member provides a compact configuration.

In an embodiment of the aerosol container, the actuating mechanism comprises a primary drive member to be driven by the dispenser machine and an actuator member to act the stem valve to said open position. The outer wall of the spout, the outer spout wall, includes an access opening to access the actuating mechanism and to drive the primary drive member from outside the outer wall by a drive component of the aerosol dispenser machine.

The spout fixed at the top end of the container body may provide a robust protection against vandalism. The spout cannot be removed easily by hand from the container body. An attempt of removing the spout will highly likely damage the aerosol container such that the spout and/or the aerosol container body cannot be used anymore.

The spout housing conceals the hollow stem of the stem valve. The stem valve is shielded by the spout housing and cannot easily or preferably not at all be operated by a person's finger. The stem valve is actuable by an inner arranged actuating mechanism which can be operated via the access opening. The access opening may be small. The access opening may have such a cross sectional dimension e.g. smaller than at most 0.5 cm to prevent a person to operate the inner actuating mechanism by a finger. Preferably, the primary drive member is arranged fully inside the spout housing. The primary drive member may be arranged without external extending parts to disable an external engagement to the primary drive member from outside the spout housing and to allow only internal engagement via the access opening. Herewith, a person cannot easily misuse the aerosol container by a manual operation. The aerosol container according to the invention is protected to prevent a spill of product.

For these reasons of getting damaged when attempting and non-manually operability, advantageously, the aerosol container is of less interest for individuals to steal the aerosol container from public places for use at other locations. Generally, a person will understand that he cannot use the aerosol container at home without the corresponding dispenser machine and will leave the aerosol container and dispenser machine in function. Herewith, the dispenser machine and relating aerosol container may be more vandalism proof, which makes the dispenser machine more suitable to be used at public or semi-public spaces. A public space is e.g. a sanitary room at an airport or petrol station. A semi-public space is e.g a sanitary room of a hotel or a personnel area of a company.

In an embodiment of the aerosol container according to the invention, the actuator member is linear movable to move the hollow stem in axial direction to the open position. The stem valve is normally closed when the hollow stem is non-tilted and not depressed in axial direction towards the container body. A resilient element returns the hollow stem in an initial closed position. A tilting movement of the hollow stem generally requires less force than a linear movement of the hollow stem to open the stem valve. The actuator member acts the hollow stem preferably in axial direction by a linear movement. Preferably, the valve of the container body is of a press down valve type which permits only an axial actuation. A required amount of force may be so large that a manual operation is hardly possible. This may make the aerosol container further vandalism proof.

In an embodiment of the aerosol container according to the invention the primary drive member is rotatable mounted in the spout housing. A rotation of the primary drive member is transferred to a movement of the actuator member to act the stem valve. Preferably, the movement of the actuator member is a linear movement, a translation, in the axial direction. The primary drive member may be a rotatable wheel. The wheel may be a Geneva wheel, a friction wheel, but is preferably a toothed gear wheel or pinion. The gear wheel is rotatable and may have a journal bearing in the spout housing. The gear wheel is except from some play not movable in axial direction. The transfer from a rotation to a translation allows a generation of a strong force which may be necessary to operate the stem valve.

In operation, the gear wheel will engage with the drive component of the dispenser machine. Preferably, the gear wheel is made of a softer material than the material of the drive component of the dispenser machine e.g. plastic versus steel to prevent wear of the drive component. Preferably, the gear wheel is a toothed gear wheel. The toothed gear wheel may be a bevel gear wheel. Preferably, the toothed gear wheel is a radial gear wheel. The radial gear wheel may obtain an engagement with the drive component of the dispenser machine by moving the aerosol container in the radial direction to obtain a tooth engagement. A radial tooth engagement may provide a reliable engagement between the dispenser machine and the aerosol container.

In an embodiment of the aerosol container according to the invention, the primary drive member comprises a rotatable gear wheel. Further, the transfer from a rotation to a translation may be arranged by a pair of a first and second cam profiles. The first cam profile is rotatable and connected to said gear wheel. The first cam profile is preferably integrated with the gear wheel. The gear wheel and first cam profile are preferably made out of one piece, e.g. by injection molding. The second cam profile may be connected to the actuator member or may be made with the actuator member out of one piece. The second cam profile may be integral with the actuator member. The gear wheel and the pair of cam profiles may be concentrically positioned with respect to the hollow stem of the stem valve. The first and second cam profiles have a profiled cam surface comprising at least one depression and at least one elevation. The second cam profile is linear movable in axial direction positioned opposite the first cam profile such that a relative rotation of the first cam profile with respect to the second cam profile causes the second cam profile to move in the axial direction, wherein the actuator member comprising the second cam profile is in engagement with the stem valve such that the axial movement of the second cam profile causes an axial movement of the hollow stem to open or close the stem valve. The cam surfaces of the pair of cam profiles are positioned opposite each other. In case that respectively an elevation of the first and an elevation of the second cam profile are positioned opposite each other, the cam profiles are positioned axially away form each other and when an elevation of the first and a depression of the second cam profile are positioned opposite each other, the cam profiles are positioned axially close to each other. Advantageously, the transfer comprising the pair of cam profiles may provide a reliable transfer of forces and movements to act the stem valve of the container body.

In an embodiment of the aerosol container according to the invention, the cooperating cam surfaces of the first and second cam profile comprise each at least two elevations, in particular three elevations. In contact, the two or three elevations may provide respectively two or three contact lines. The two, but preferably three contact lines may increase a stable support of the first cam profile to the second cam profile.

In an embodiment the aerosol container according to the invention is a soap aerosol container. The product in the container body then is soap, for example hand soap for washing a person's hands. The soap aerosol container is for use in a dispenser machine. The soap aerosol container is preferably positioned upside down in the dispenser machine to prevent hardening of soap in the hollow stem of the stem valve. The soap aerosol container is upside down when the spout is positioned beneath the container body. The soap aerosol container may be loaded in the dispenser machine, wherein the spout is positioned into a receiving chamber of the dispenser machine.

In an embodiment of the aerosol container according to the invention, the spout opening comprises a drip stop valve to stop dripping of product from the aerosol container after a discharge. In particular, when the product is a foaming soap, residue of the product may be left in the hollow stem after a discharge operation. After a time, the residue may leak out of the hollow stem. Residue of foamed soap in the hollow stem may then collapse and drip slowly out of the hollow stem. Advantageously, the drip stop valve may be arranged to prevent leaking of product out of the hollow stem to prevent dripping.

In an embodiment of the aerosol container according to the invention, the drip stop valve comprises a stopper and a stopper seat, wherein the stopper seat is connected or integral with the outer wall and wherein the stopper is connected to the axially movable actuator member. In a preferred embodiment, the stopper is needle shaped. The stopper may be elongated and hollow. The stopper may be axially aligned with the hollow stem of the stem valve. The hollow stopper may be out of one piece with the actuator member. Advantageously, the stopper, the second axial cam profile and the contacting surface of the actuator member may be made out of one piece. The actuator member may be made by injecting molding. The hollow stopper may be in fluid communication with the hollow stem.

In an embodiment of the aerosol container according to the invention, the aerosol container comprises orientation means to orient the aerosol container in a predetermined orientation and unambiguously in the dispenser machine. The orientation means may be provided on the container body. Preferably, the orientation means are provided on the spout housing. The spout housing may comprise a spout lock to orient the aerosol container in a receiving chamber of the dispenser machine. The spout lock may be e.g. a flat surface at the outer wall of the spout housing. The spout lock defines a position in rotation of the aerosol container with respect to the dispenser machine. Advantageously, the spout lock orients the aerosol container in the dispenser machine, such that the access opening included in the spout housing directs to the drive component of the dispenser machine. Additionally, the spout lock may be positioned at a canned aerosol container such that a longitudinal extending seam at the outer surface of the container body is oriented to the backside of the dispenser machine.

In an embodiment of the aerosol container according to the invention may have a recognizing means at an outer surface which corresponds with a type of a contained product. The aerosol container may have at least one protrusion which is indicative of the product in the container body. The dispenser machine may comprise at least one relating cooperating recognizing means e.g. a microswitch to recognize the presence and/or type of an aerosol container in a storage space of the dispenser machine. Pinion of different height, or positioning may be used to trigger the microswitches to recognize the type of loaded aerosol container.

In an embodiment of the aerosol container according to the invention, the access opening may be covered by a removable cover before use. Generally, the aerosol container is a disposable aerosol container. A user may note a covered access opening which may provide a clear indication that the aerosol container is still unused. A cover for the access opening may further be advantageous in that it may prevent the access opening and inner actuating mechanism from contaminations. The cover may be a simple piece of tape. The tape may be pulled away by a user. The cover may alternatively be a hard cover. The hard cover may be shifted away during loading in the dispenser machine when the aerosol container is put in the receiving chamber.

Further, the invention relates to a dispenser machine for use in combination with an aerosol container according to the invention. The dispenser machine and corresponding aerosol container may be technically complementary to each other as a socket and corresponding plug. The dispenser machine has technical features which are specifically designed to interact with complementary technical features of the aerosol container.

The invention further relates to a system comprising a dispenser machine and/or an aerosol container.

The invention further relates to a use of an aerosol container in a dispenser machine.

The invention further relates to a method for dispensing a product from an aerosol container by using a dispenser machine.

Further preferred embodiments are defined in the subclaims.

BRIEF DESCRIPTION OF THE DRAWINGS

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims.

In the drawings.

Identical reference numbers are used in the drawings to indicate similar or identical components.

DETAILED DESCRIPTION

Figure 1A:
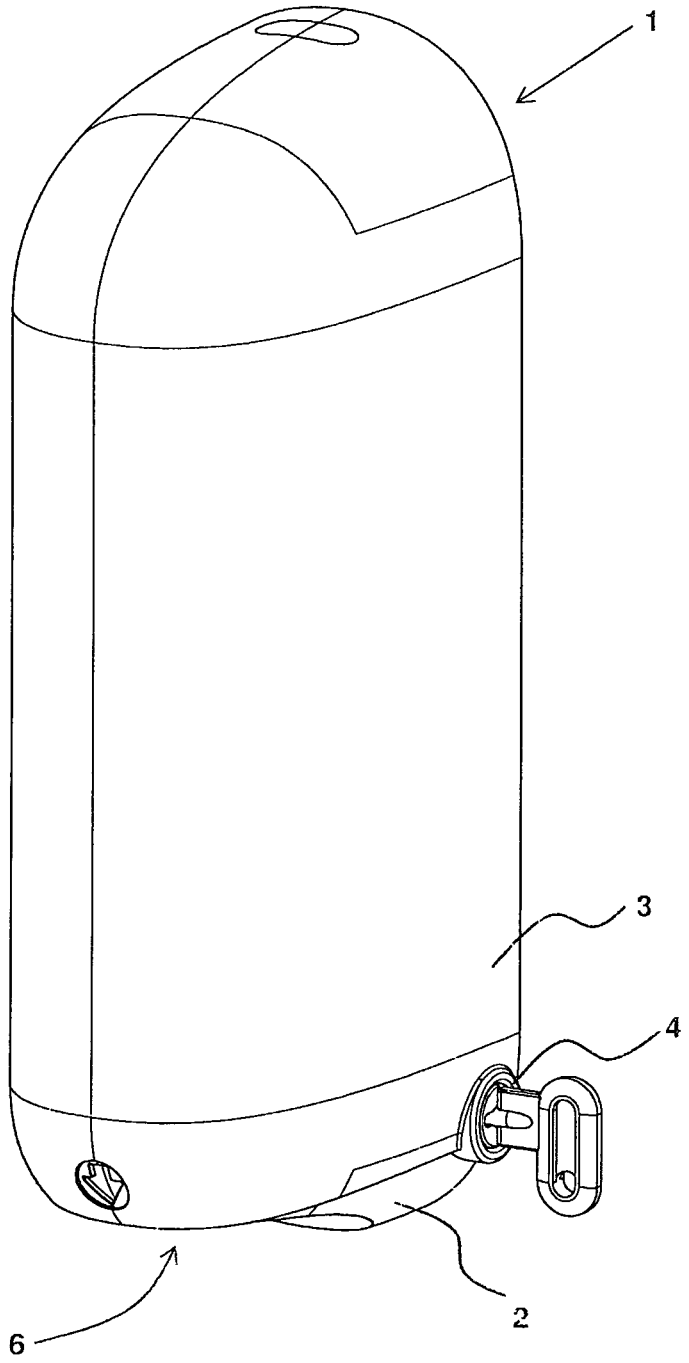
FIG. 1A shows a perspective view of an embodiment of an aerosol dispenser machine according to the invention.

FIG. 1A shows a dispenser machine 1 according to the invention. The dispenser machine 1 comprises a frame 2. The frame 2 can be used to mount the dispenser machine to a wall. The dispenser machine 1 is in particular suitable to serve as a soap dispenser machine. The soap dispenser machine may be wall mounted. The dispenser machine 2 is in particular suitable to be mounted at public places. The soap dispenser machine may be mounted to a wall in a public sanitary room.

Figure 1B:
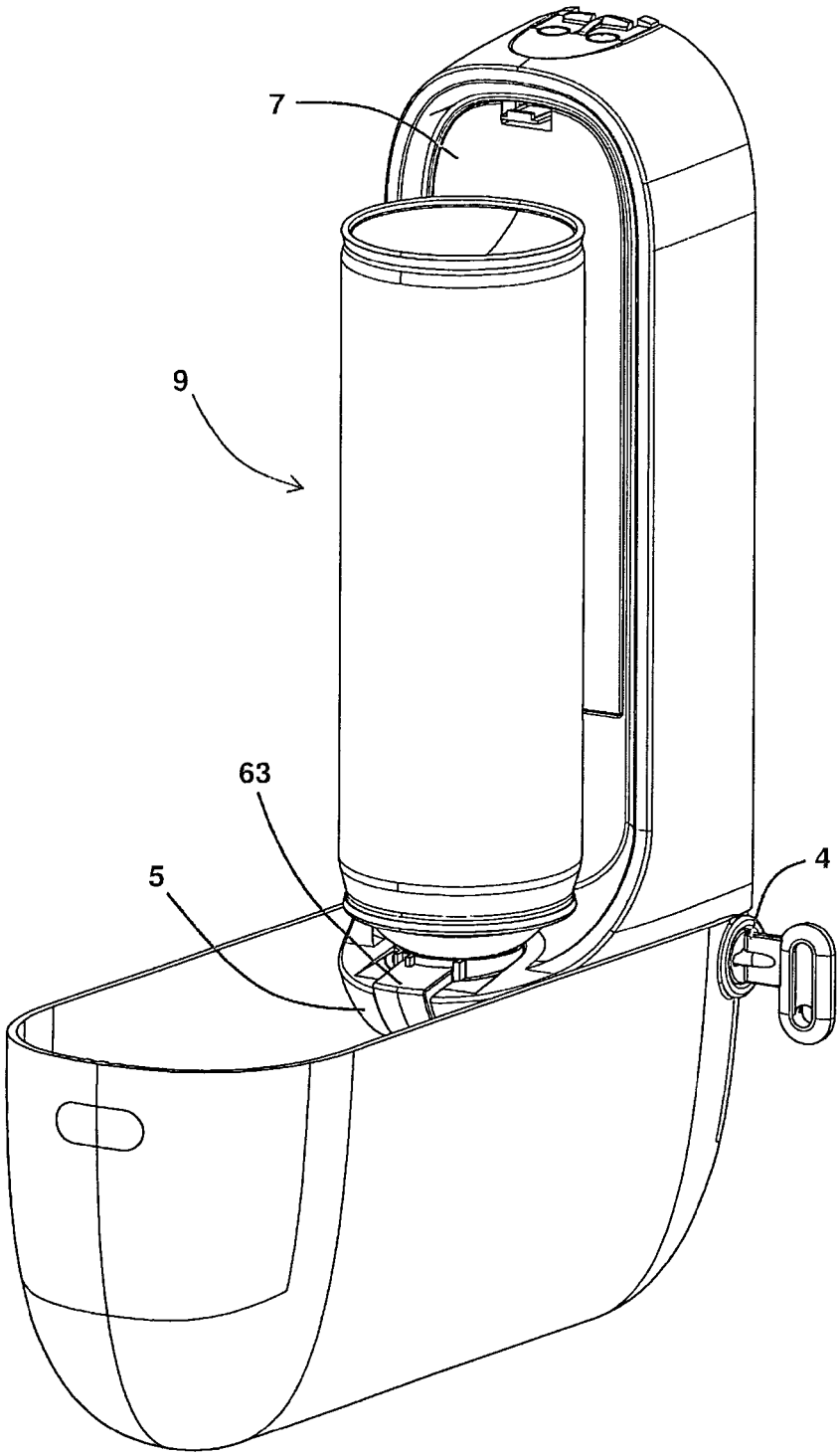
FIG. 1B shows the dispenser machine as shown in FIG. 1A in a loading position.

As shown in FIG. 1B, the dispenser machine 1 has a storage space 7 which is covered by a cover 3. The cover 3 is pivotally connected to the frame 2. The cover 3 can be opened for loading an aerosol container. After loading the aerosol container 9 in the storage space 7, the cover 3 can be closed and locked to the frame 2 by a latch. FIG. 1B shows the dispenser machine having the cover 3 in an open position. The cover 3 is rotatable about a horizontal axis 4 in a lower region such that the cover 3 can be opened by moving the cover 3 downwards. The cover 3 can be lifted upwards to close the cover 3, wherein the cover fully conceals the aerosol container 9 in the storage space 7. The cover 3 can be locked with a key in the closed position by a lock which is incorporated in a pivoting shaft which defines the horizontal axis 4.

The dispenser machine 1 has a discharge opening 6 at a lower region of the frame 2. The dispenser machine 1 has detecting means to detect whether a person's hand is present under the discharge opening 6. If a person's hand is present, the dispensing machine 1 will be activated and dispense a product e.g. soap.

As shown in FIG. 1B the frame 2 has a support 5 to support a filled aerosol container 9.

Figure 1C:
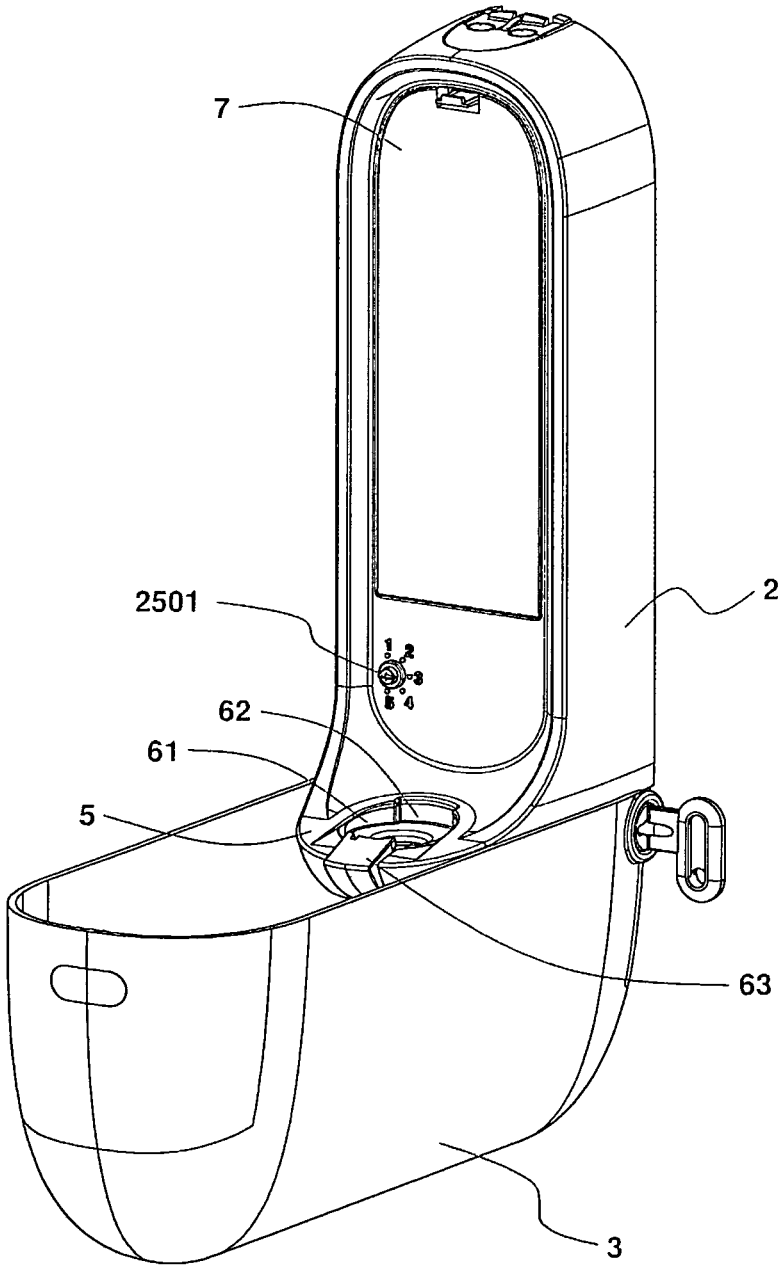
FIG. 1C shows an unloaded dispenser machine as shown in FIG. 1A.

FIG. 1C shows an empty opened dispenser machine 1. No aerosol container is installed in the storage space 7 of the dispenser machine 1. FIG. 1C shows the support 5 which has a receiving chamber 61 for receiving a spout of the aerosol container. The receiving chamber 61 extends through the support 5 and runs into the discharge opening 6. The receiving chamber 61 has orientation means which include an orienting member 62 for orienting an aerosol container within the dispenser machine 1 in a rotational direction about a longitudinal axis of the aerosol container.

The dispenser machine 1 has a locking body 63 to lock the aerosol container 9 in the dispenser machine. The locking body 63 is positioned at the support 5. The locking body 63 is positioned at a front region of the dispenser machine. The locking body is pivotally connected to the frame 2 of the dispenser machine. The locking body 63 is movable from an open position to receive an aerosol container in the receiving chamber 5 towards a closed position wherein an aerosol container is locked in the receiving chamber. In the closed position the locking body 63 engages the aerosol container 9. An operation of the locking body cooperates with an operation of the cover 3 of the dispenser machine. When closing the cover 3, an inner portion of the cover 3 contacts the locking body 63 and presses the locking body in the closed position.

The locking body 63 is designed to make an unique engagement with an aerosol container 9. The locking body 63 fits to one type of aerosol containers. Herewith, the locking body is designed as a recognizing means to recognize a suitable aerosol container for the dispenser machine. If an unsuitable aerosol container is placed in the receiving chamber 61, it will not be possible to close the locking body 63 and hence it will not be possible to close the cover 3. This aspect will be further explained with reference to FIGS. 3A and 3B.

An embodiment of the aerosol container 9 is shown in FIG. 2A-2D. The aerosol container 9 has a container body 10 and a spout 20. The container body 10 has a cylindrical wall 11, a bottom end 12 and a top end 13. The cylindrical wall 11 defines an axial direction of the aerosol container 9. A spout 20 is fixed to the top end 13 of the container body 10. The aerosol container 9 has to be positioned upside down in the dispenser machine 1. The spout 20 of the aerosol container 9 is than supported by the support 5. The spout 20 is received in the receiving chamber 61.

Figure 2A:
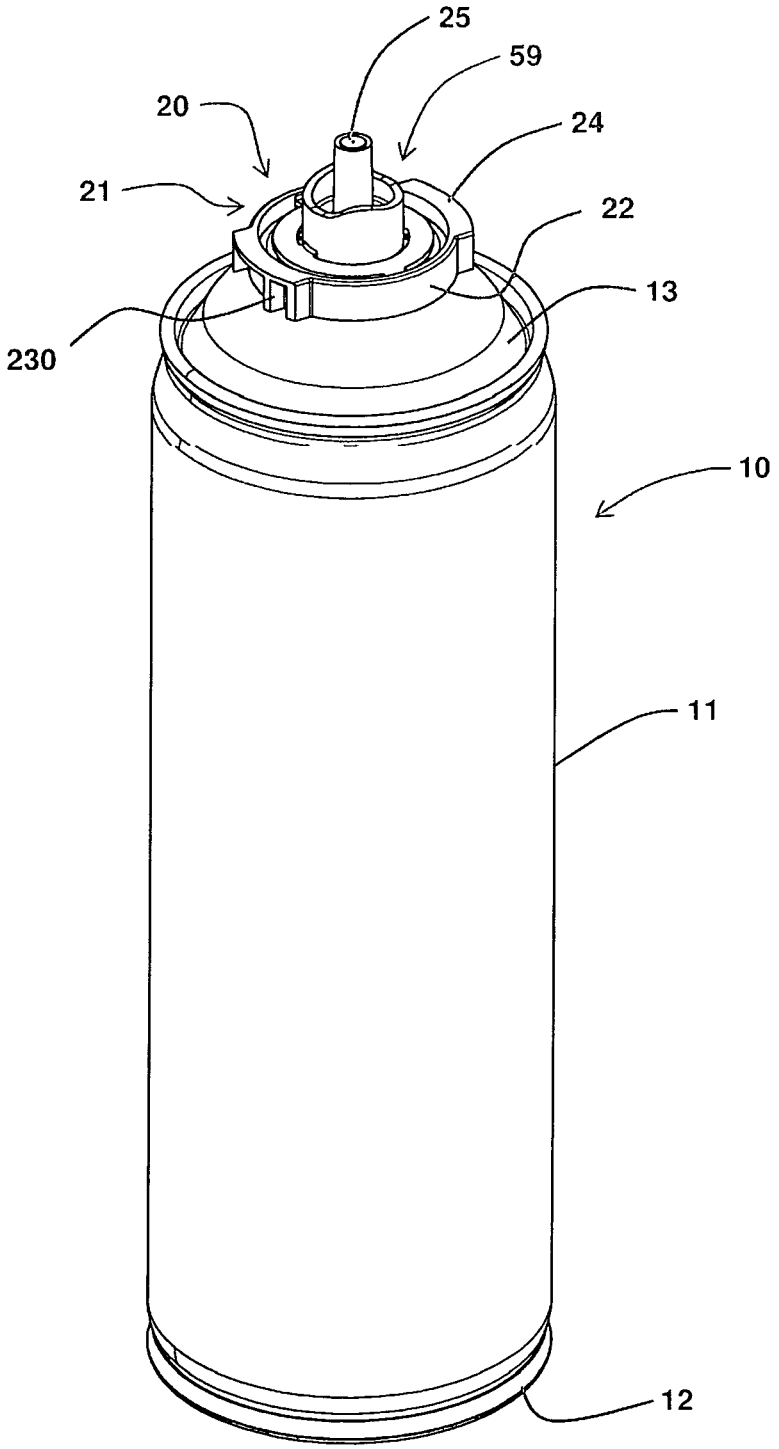
FIG. 2A shows in a perspective view a first embodiment of an aerosol container according to the invention.

The spout 20 has an injection moulded spout housing 21. The spout housing 21 has an outer wall 22 which defines an outer circumference of the spout. As shown in FIG. 2A, the spout housing 21 has a non-circular shape. The spout 20 comprises a spout lock 24 for a rotational lock of the spout 20 in the receiving chamber of the dispenser machine 1. The spout lock 24 here is formed by a bulge at the outer circumferential wall 22 of the spout housing 21. The bulge which forms the spout lock 24 fits in a recess at the circumference of the receiving chamber 61. After placement of the aerosol container 9 in the dispenser machine 1, the spout lock 24 prevents the aerosol container 9 from rotating with respect to the dispenser machine.

The outer wall 22 circumferences an inner actuating mechanism 50. The inner actuating mechanism 50 has an actuator member 59 for actuating a nozzle of the container body 10. The actuator member 59 is centrally positioned inside the spout housing 21. The aerosol container 9 will be elucidated in further detail in FIG. 2B-2D.

Figure 2B:
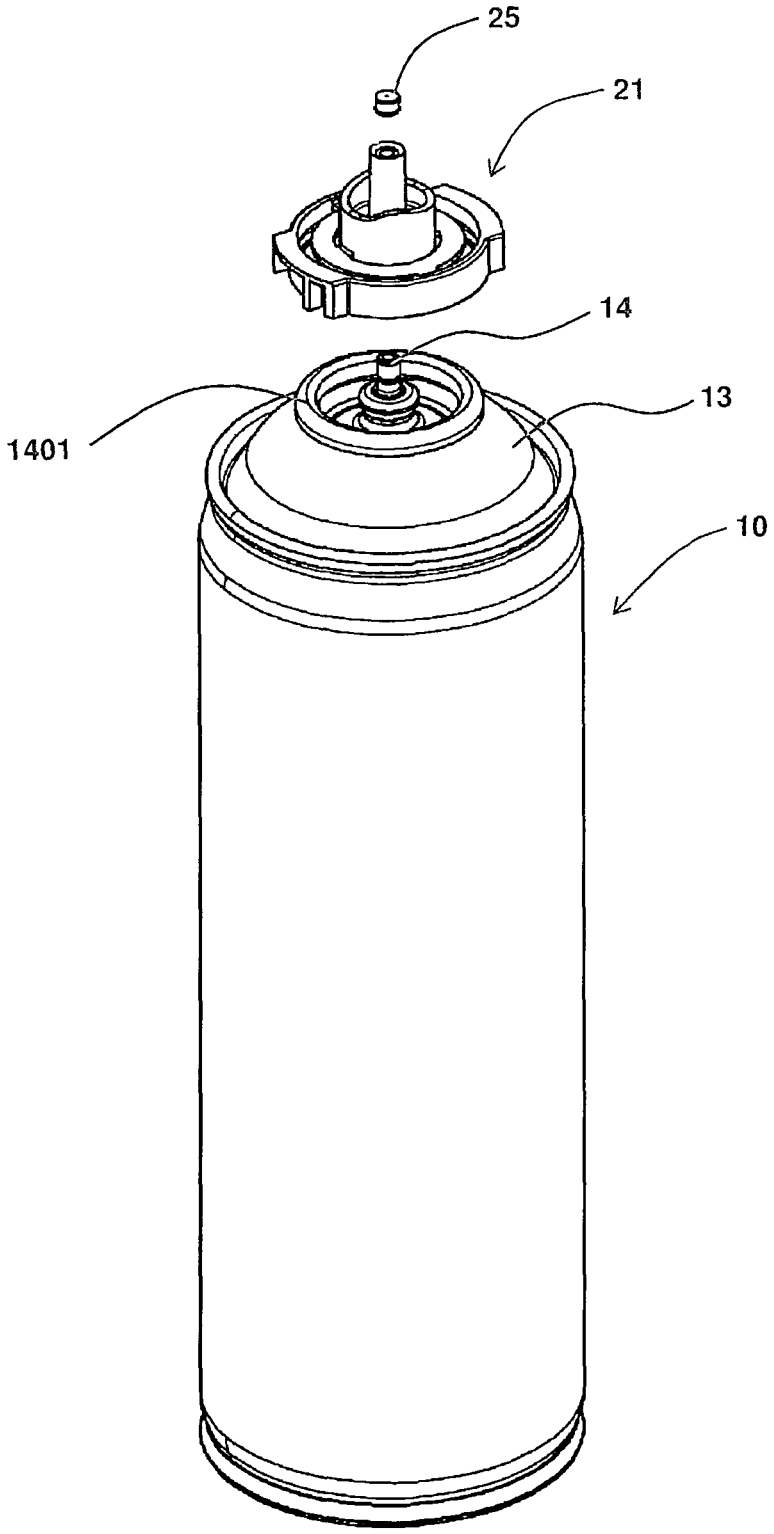
FIG. 2B shows in an exploded view an assembly of a container body and a spout of the aerosol container as shown in FIG. 2A.

FIG. 2B shows the container body 10, wherein a stem valve 14 is arranged at the top end 13 of the container body. The stem valve is shown very schematically as stem valves are generally known. The stem valve 14 has a hollow stem 41 for discharging product from the container body 10. The stem valve 14 is normally closed in a closed position and is actuable to an open position by tilting and/or axially moving the hollow stem 141. The stem valve 14 opens when the stem is depressed towards the container body and/or when the stem is depressed to tilt the hollow stem in a radial direction.

Such a container body without a spout but including such a stem valve is commonly known in the prior art. Such a container body 10 is used for all kind of products like hair spray, insecticides, lubricants, dyes, soaps etc. The container body 10 may be made out of metal, in particular out of stainless steel. The body may also be of plastic. The container body 10 here is formed by a sheet material which is rolled in a longitudinal direction and closed along a longitudinal edge e.g. by welding. The container body has a longitudinal extending seam along the cylindrical wall 11. When loading the aerosol container 9 in the dispenser machine 1, the seam at the cylindrical wall is preferably directed towards the frame 2 at the back side. This orientation of the aerosol container 9 is determined by the spout lock 24 at the outer wall 22 of the spout 20.

FIG. 2B shows in an exploded view the arrangement of the spout 20 in further detail. The spout 20 comprises a spout housing 21 which houses several components of the inner actuating mechanism 50.

The spout housing 21 is solidly fixed to an upper outer edge 1401 of the container body 10. As shown in FIG. 2D, the spout housing has a once only snap on fitting at an inner circumference of the outer wall 22 to snap the spout housing 21 to the upper outer edge of the container body 10. A user cannot easily remove the spout housing from the container body 10. The solid fixation of the spout housing will prevent a person to remove the spout housing from the container body. An attempt to remove the spout housing may damage the aerosol container.

The spout 20 further comprises an outlet opening 25. The outlet opening 25 is in fluid communication with the hollow stem of the stem valve 14. The outlet opening is provided with an outlet nozzle. The outlet nozzle is designed for discharging a spray. The outlet nozzle is connected to the spout housing 21 at an upper region.

The inner actuating mechanism 50 is provided to actuate the stem valve 14 to the open position. The actuating mechanism 50 here is arranged to depress the hollow stem 141 in the axial direction towards the container body 10.

Figure 2C:
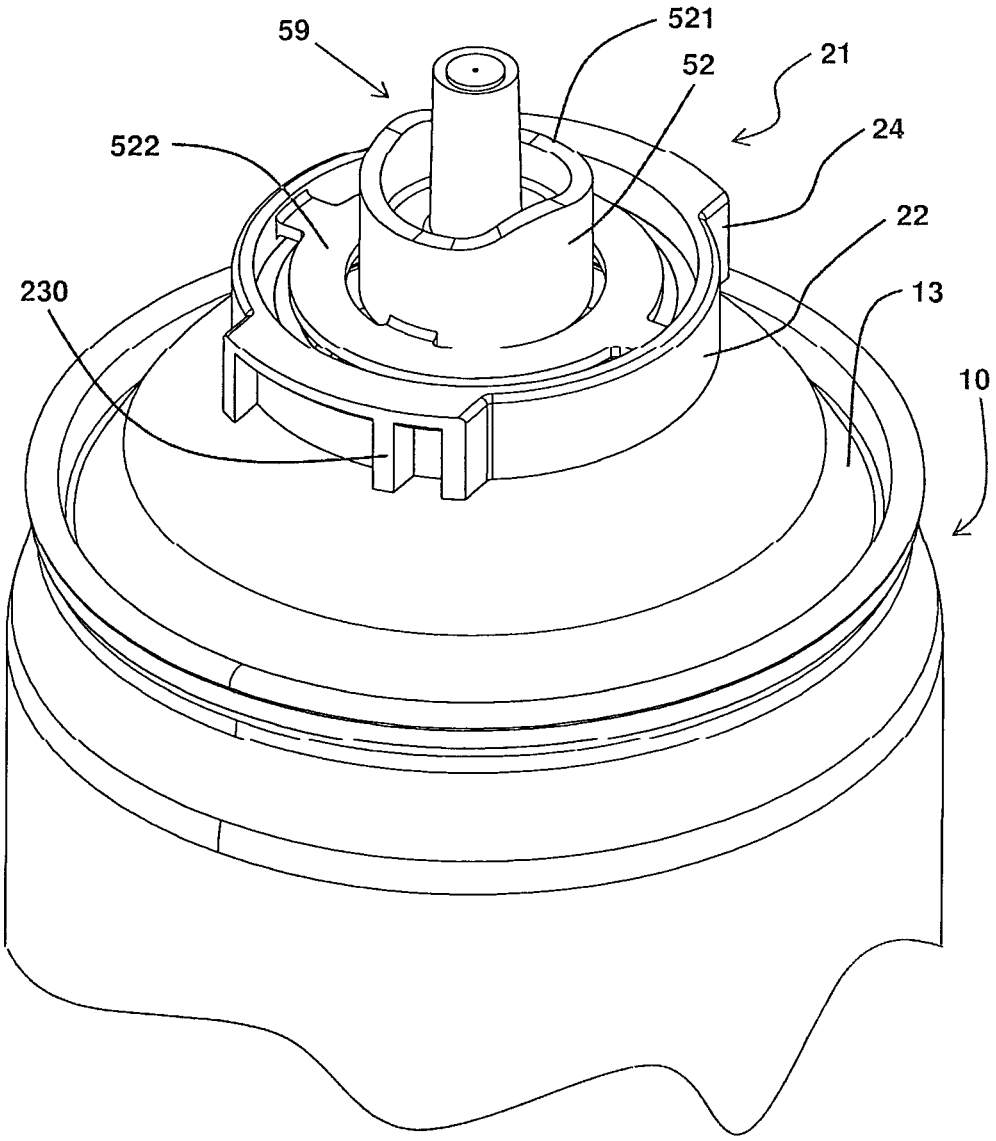
FIG. 2C shows an enlarged view of the spout of the aerosol container of FIG. 2A.
Figure 2D:
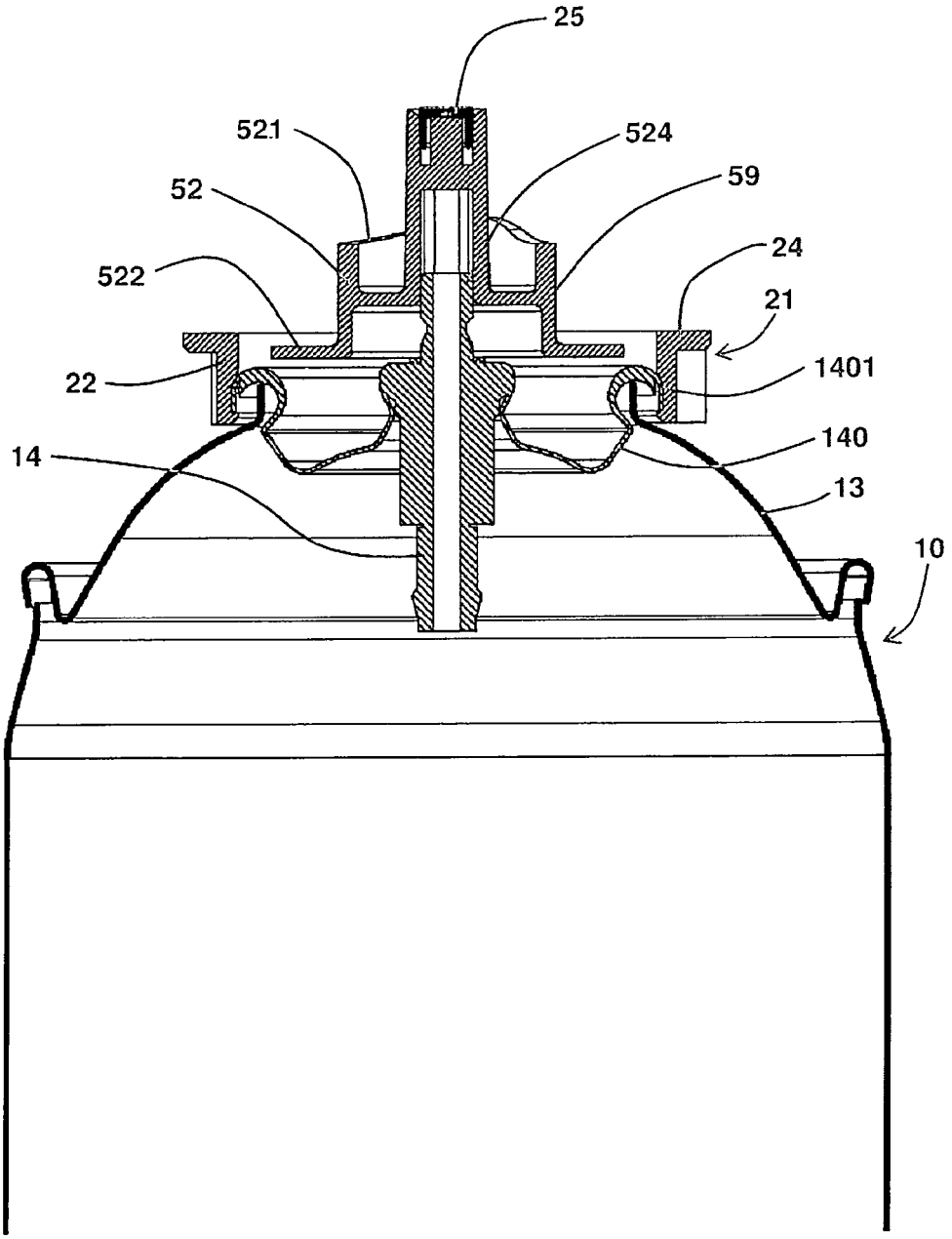
FIG. 2D shows a cross sectional view of the aerosol container as shown in FIG. 2C.

FIG. 2C shows the inner actuating mechanism 50 in further detail. The actuating mechanism comprises an actuator member 59. The actuator member comprises a cam profile 52. Herewith, the actuating mechanism 50 is cam operated. The component comprising the cam profile 52 defines an actuator member to act on the stem valve 14 to displace it to the open position. The cam profile 52 here is axially movable to depress the hollow stem 141. The actuator member comprises a contact surface 524 which is in contact with the stem valve 14.

The cam profile 52 has a cylindrical body including a central axis which extends in axial direction. The cam profile 52 has a cam surface 521 at a top face of the cylindrical body which in this example has two depressions and two elevations in axial direction. The two elevations are positioned opposite each other with respect to the central axis through the cylindrical body. The cam profile 52 has rotational symmetry. An object with rotational symmetry is an object that looks the same after a certain amount of rotation. An object may have more than one rotational symmetry. Rotational symmetry of order n, also called n-fold rotational symmetry, or discrete rotational symmetry of the nth order, with respect to a particular point (in 2D) or axis (in 3D) means that rotation by an angle of 360°/n (180°, 120°, 90°, 72°, 60°, 51⅔°, etc.) does not change the object. With two elevations, the cam profile 52 has a two fold rotational symmetry. In particular, the cam profile has at least two fold rotational symmetry, more in particular the cam profile 52 has at least a four fold rotational symmetry. In particular the height difference in between an elevation and a depression at the cam surface 521 is at most 5 mm. The cam surface 521 is exposed in axial direction. The cam profile 52 is uncovered and accessible to be engaged from a component of the dispenser machine 1 to operate the actuator member 59.

The cam profile 52 is locked with respect to the outer wall 22 of the spout 20 in a rotational direction about the central axis by a lock member 522. The lock member 522 prevents a relative rotation but permits an axial displacement of the actuator member 59. The lock member 522 is a spring leaf. The lock member 522 is resilient and elastically deforms when loaded. The lock member 522 is ring shaped and circumferences the cam profile 52 of the actuator member 59. The lock member is fixed to the outer wall 22 at two opposite positioned outer fixation points and fixed to the actuator member 59 by two opposite positioned inner fixation points. The outer fixation points are staggered with respect to the inner fixation points over 90 degrees in rotational direction. The outer wall 22, the lock member 522 and the actuator member 59 which includes the cam profile 52 are integrally molded and out of one piece.

FIG. 2C further shows a protrusion 230 at the outer wall 22 of the spout housing 21. The protrusion 230 is arranged to identify the aerosol container 9. The positioning of the protrusion 230 provides a unique engagement with the locking body 63 of the dispenser machine 1. The locking body 63 is provided with a corresponding recess at an outer surface which cooperates with the protrusion 230. When the protrusion 230 matches with the recess of the locking body, the aerosol container is suitable to be installed in the dispenser machine. In a particular, the locking body 63 of the dispenser machine and the spout housing 21 of the aerosol container 9 may have an equal color to directly inform a user whether the aerosol container 9 fits or not. A mismatch of colors may indicate that the aerosol container is not suitable to be installed in the dispenser machine.

Figure 3A:
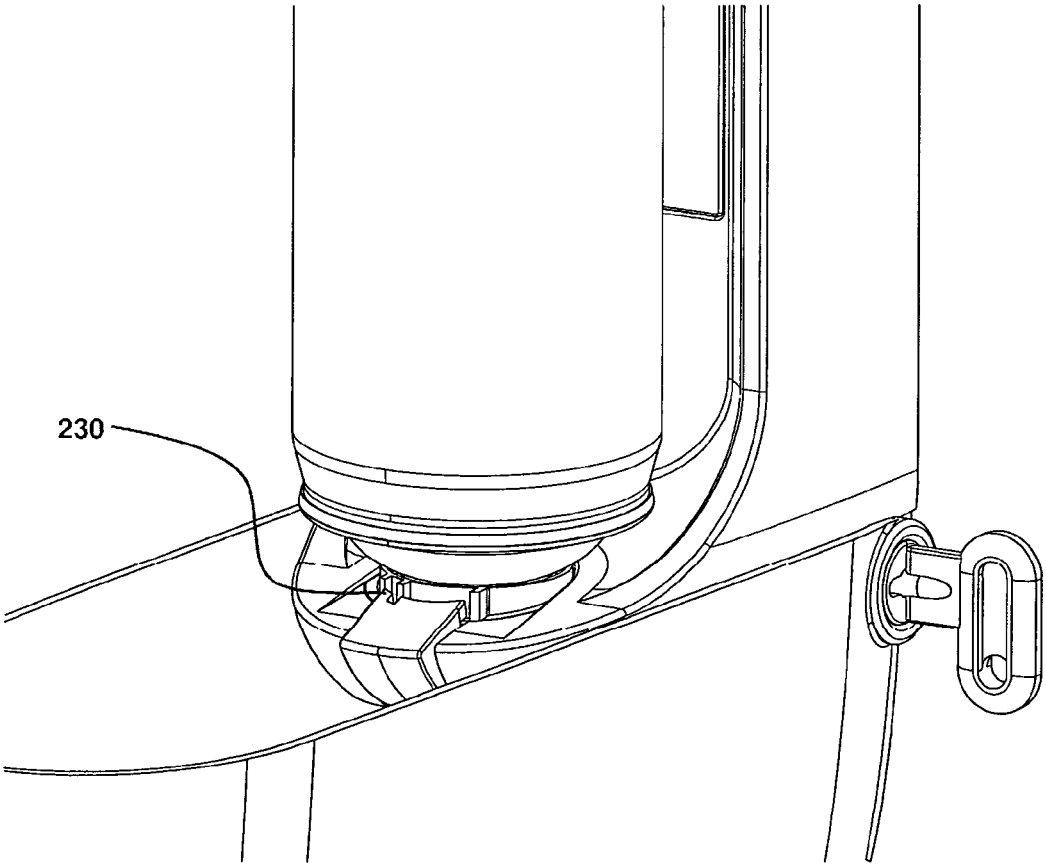
FIG. 3A and FIG. 3B show two different configurations of a locking body of the dispenser machine which include recognizing means to identify a suitable aerosol container which fits in the dispenser machine.
Figure 3B:
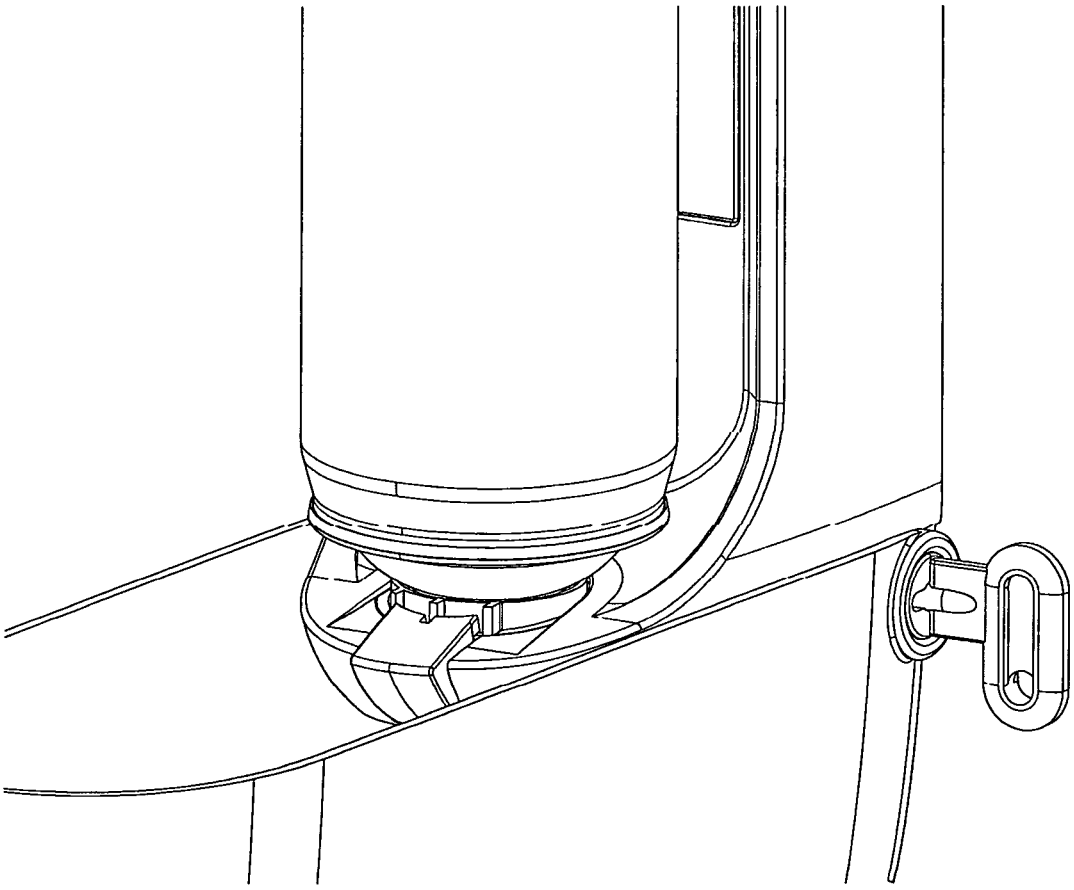

FIGS. 3A and 3B further illustrate the engagement of the locking body 63 and the spout housing 21. FIGS. 3A and 3B show two configurations of the locking body 63, wherein the recess in the locking body 63 is positioned in accordance with the protrusion 230 of the spout housing 21. In case of a corresponding positioning of the recess and protrusion 230, the locking body 63 can be closed which means that the aerosol container is suitable for the dispenser machine 1. So, the locking body 63 serves also as a recognizing means to recognize a suitable aerosol container.

Figure 4A:
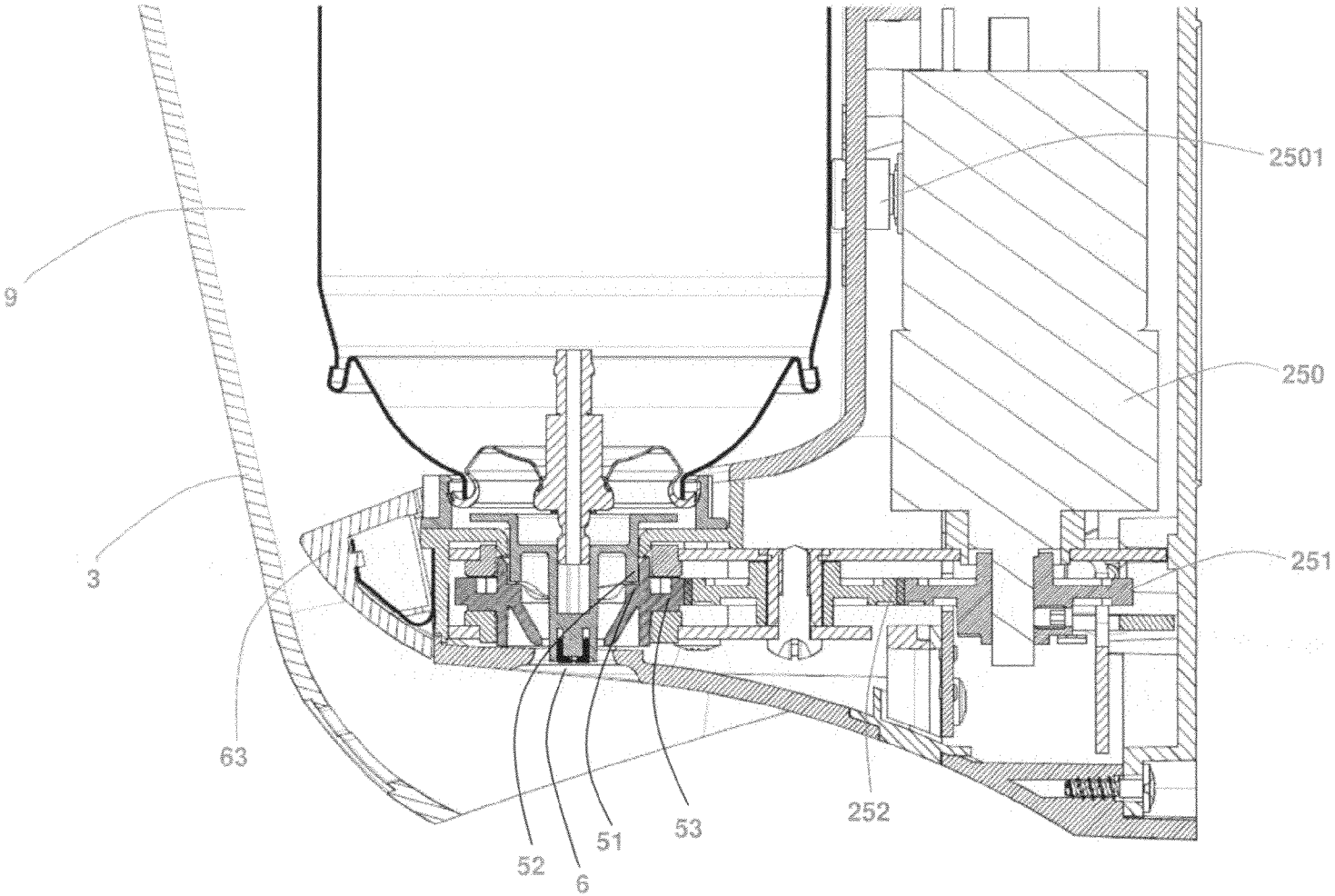
FIGS. 4A and 4B show the dispenser in respectively an open, non operational mode and in a closed, operational mode.
Figure 4B:
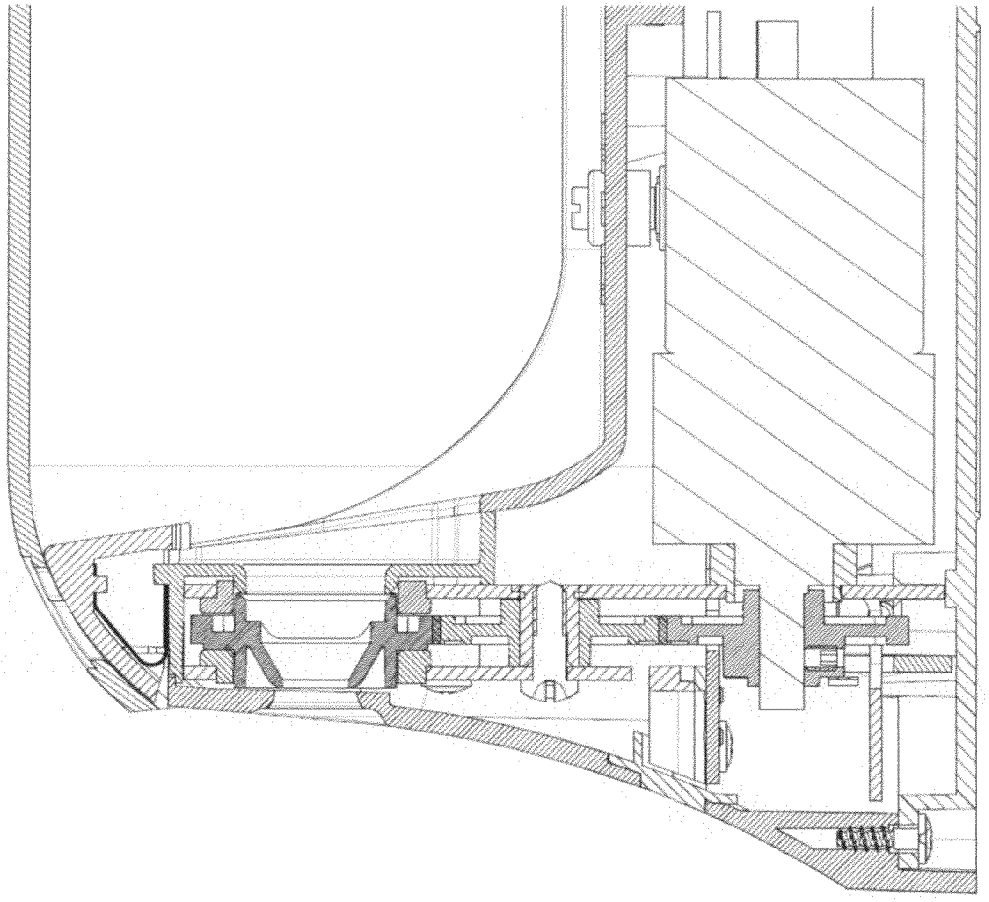

FIGS. 4A and 4B show the dispenser in respectively an open, non operational mode and in a closed, operational mode. During a closing movement of the cover 3 of the dispenser machine 3, the cover 3 contacts the locking body 63 to press the locking body 63 in a locking position. In case that an unsuitable aerosol container 9 is installed, it will be impossible to close the cover 3 of the dispenser machine.

FIG. 4A shows an installed aerosol container 9 in the dispenser machine 1. The aerosol container 9 is positioned up side down in the dispenser machine. The spout 20 is received in the receiving chamber 61 at the support 5. The dispenser machine comprises a first cam profile 51. The first cam profile 51 is centrally positioned at the support 5 in the receiving chamber 61. The first cam profile 51 is designed to cooperate with the cam profile 52 of the aerosol container 9, which cam profile 52 will be hereafter be referred as the second cam profile 52. The first cam profile 51 has a first cam surface 511.

During an operation the first cam surface 511 is in contact with the second cam surface 521 of the second cam profile 52. Both cam profiles 51, 52 are provided with at least one depression and/or elevation. The first cam profile 51 here includes two depressions and two elevations. The second cam profile 52 here includes also two depressions and two elevations which correspond in geometry with the depressions and elevations of the first cam profile 51. The second cam profile 52 is arranged in mirror symmetry with the first cam profile 51. A movement of the first cam profile 51 in axial direction is blocked. In operation a rotation of the first cam profile 51 will result in an axial movement of the second cam profile 52. In case that an elevation of the first cam profile 51 is positioned opposite a depression of the second cam profile 52, the actuator member is positioned away from the container body 10 and the stem valve is closed. The first and second cam profiles are in that mode positioned close to each other. In case that an elevation of the first cam profile 51 is opposite an elevation of the second cam profile 52, the first and second cam profile will be spaced from each other. In that mode, the actuator member 59 is positioned towards the container body 10 and will exert a depressing force on the stem valve 14. The hollow stem will be depressed and the stem valve 14 is opened.

Figure 4C:
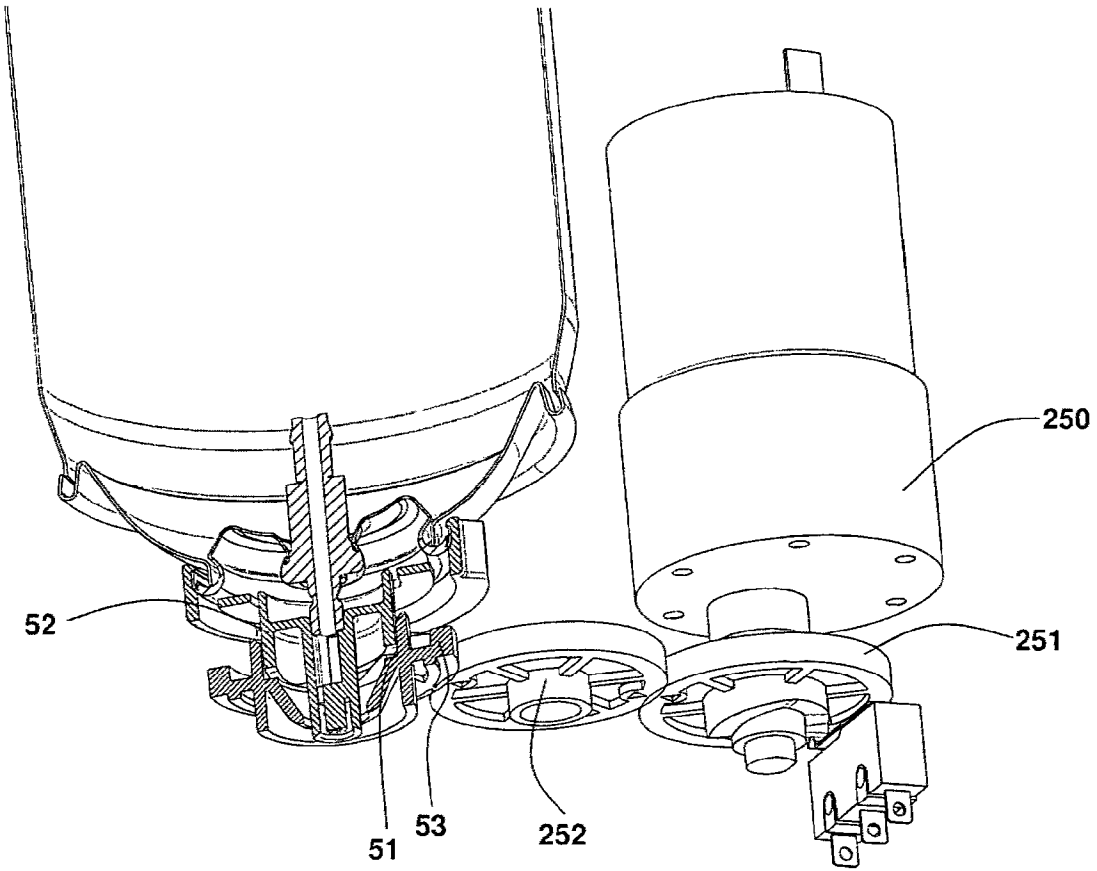
FIG. 4C shows in a perspective view a drive system of a dispenser machine and an aerosol container.

FIG. 4C further illustrates in an isolated view a drive system to drive the first cam profile 51. The first cam profile 51 is drivable in rotation by the drive system which comprises a transmission with a first and second gear wheel 251,252 and a motor 250. The transmission comprises a first gear wheel which cooperates with a micro switch to switch the motor 250 off after an activation. The micro switch may switch the motor off after one turn of the first gear wheel 251, The speed of the motor may be controlled by a control unit which may have an operator interface 2501 at the front side of the frame 2 as shown in FIG. 1C. The operator interface is positioned under the cover 3 when placed in the closed position which is out of reach of a user.

The transmission has a second gear wheel 252 which is connected to the primary gear wheel 53 which can be rotated to act the actuator member 59. The primary gear wheel 53 is molded in one piece with the first cam profile 51.

Figure 5A:
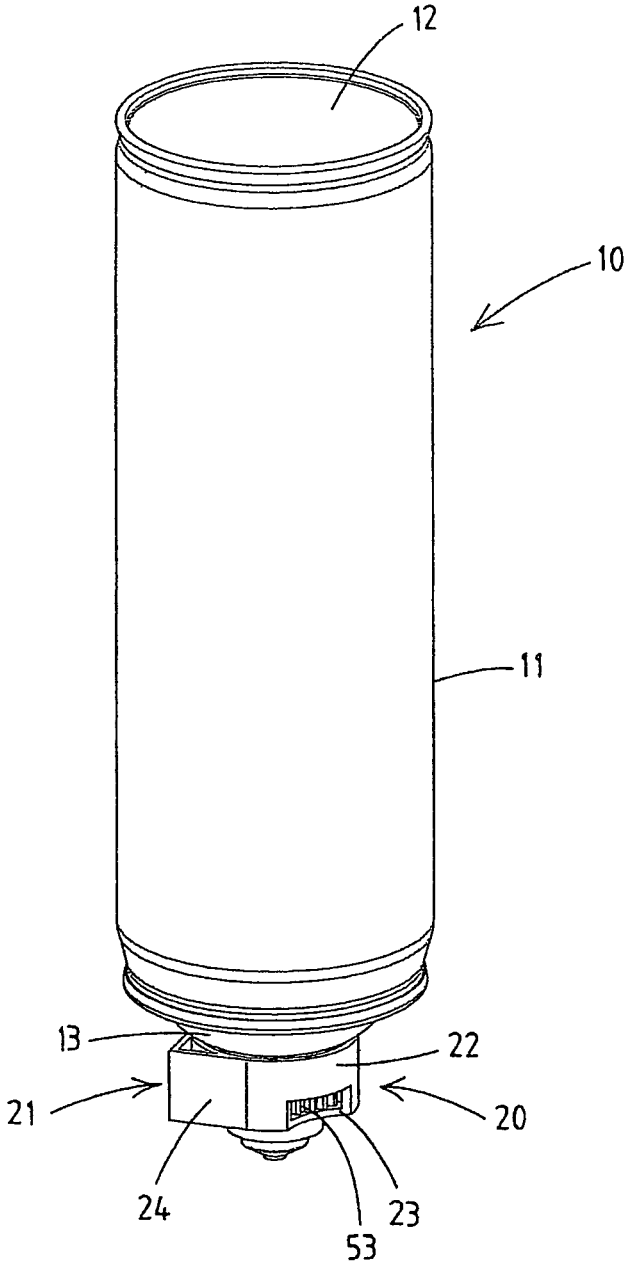
FIG. 5A shows in a perspective view a second embodiment of an aerosol container according to the invention.

Another embodiment of the aerosol container 9 is shown in FIG. 5A and has a container body 10 and a spout 20. The aerosol container 9 is positioned upside down in the dispenser machine 1. The spout 20 of the aerosol container 9 is supported by the support 5. The support 5 has a receiving chamber 61 for receiving the spout 20 of the aerosol container 9.

As shown in FIG. 5A, the spout 20 here has a non-circular shape. The spout 20 comprises a spout lock 24 for a rotational lock of the spout 20 in the receiving chamber 61 of the dispenser machine 1. The spout lock 24 here is formed by a flat surface at an outer wall 22 of the spout 20.

The container body 10 has a cylindrical wall 11, a bottom end 12 and a top end 13. The cylindrical wall 11 defines an axial direction of the aerosol container 9. A spout 20 is fixed to the top end 13 of the container body 10. The spout 20 has an injection moulded spout housing 21. The spout housing 21 has a outer wall 22. The outer wall 22 has an access opening 23 to access an inner actuating mechanism. The inner actuating mechanism 50 has a primary gear wheel 53 to be accessed and engaged by a drive component of the dispenser machine. The gear wheel 53 is accessible from outside the spout housing 21.

Figure 5B:
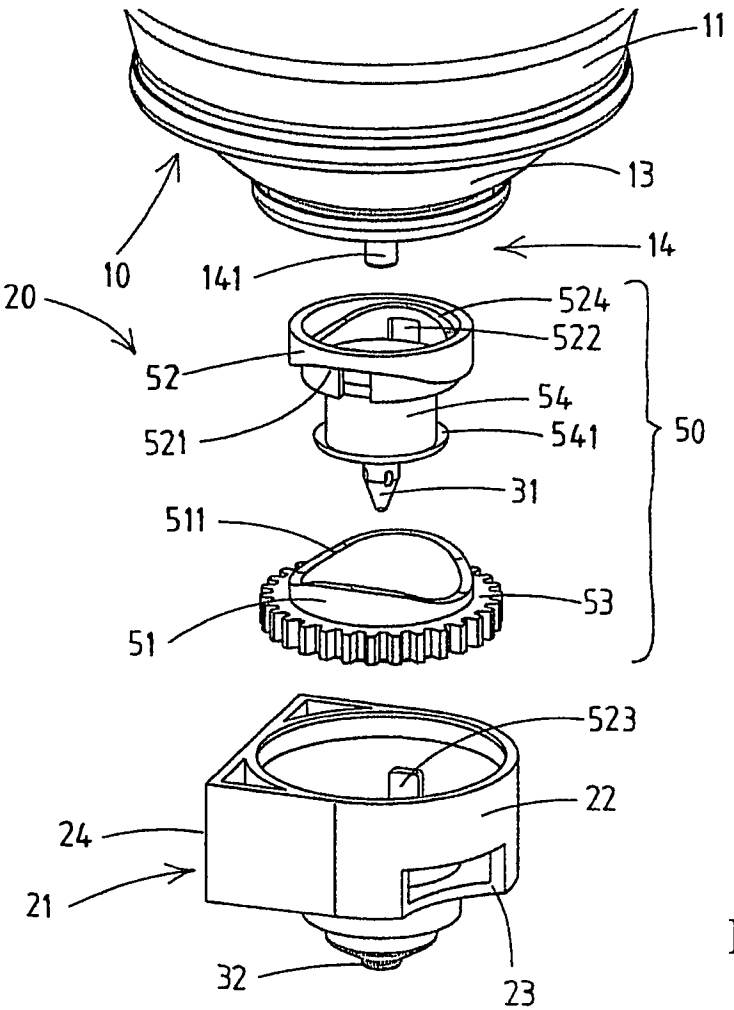
FIG. 5B shows in an exploded view an assembly of a container body and a spout according to the invention.

FIG. 5B shows in an exploded view, the container body 10, wherein a stem valve 14 is arranged at the top end 13 of the container body. The stem valve is shown very schematically as stem valves are generally known. The stem valve 14 has a hollow stem 41 for discharging product from the container body 10. The stem valve 14 is normally closed in a closed position and is actuable to an open position by tilting and/or axially moving the hollow stem 141. The stem valve 14 opens when the stem is depressed towards the container body and/or when the stem is depressed to tilt the hollow stem in a radial direction.

Such a container body without a spout but including such a stem valve is commonly known in the prior art. Such a container body 10 is used for all kind of products like hair spray, insecticides, lubricants, dyes, soaps etc. The container body 10 may be made out of metal, in particular out of stainless steel. The body may also be of plastic. The container body 10 here is formed by a sheet material which is rolled in a longitudinal direction and closed along a longitudinal edge e.g. by welding. The container body has a longitudinal extending seam along the cylindrical wall 11. When loading the aerosol container 9 in the dispenser machine 1, the seam at the cylindrical wall is preferably directed towards the frame 2 at the back side. This orientation of the aerosol container 9 is determined by the spout lock 24 at the outer wall 22 of the spout 20.

FIG. 5B shows in the exploded view the arrangement of the spout 20 in further detail. The spout 20 comprises a spout housing 21 which houses several components of an inner actuating mechanism 50. The inner actuating mechanism 50 is provided to actuate the stem valve 14 to the open position. The actuating mechanism 50 here is arranged to depress the hollow stem 141 in the axial direction towards the container body 10. The actuating mechanism 50 comprises a gear wheel 53 as a primary drive member. The gear wheel 53 is made of plastic. The gear wheel 53 has a toothed outer contour which is engageable by a drive component (252, see FIG. 7B) of the dispenser machine. The rotation axis of the gear wheel is parallel to the axis of the container body. The gear wheel 53 can be engaged through the access opening 23 in the spout housing.

Further, the inner actuating mechanism 50 here comprises a pair of a first cam profile 51 and a second cam profile 52. The actuating mechanism 50 is cam operated. The first and second cam profiles have a cam surface 511, 521 which in this example have both two depressions and two elevations in axial direction which provide stability in tilt direction. The first cam profile 51 is rotatable positioned. The first cam profile 51 is connected to the gear wheel 53 to rotate together with the gear wheel 53. The second cam profile 52 is locked with respect to the spout housing 21 in rotational direction by a pair of a first lock member 522 at the second cam profile 52 and a second lock member 523 at the spout housing 21. The component comprising the second cam profile 52 defines an actuator member to act on the stem valve 14 to displaced it to the open position. The second cam profile 52 here is axially movable to depress the hollow stem 141. The actuator member comprises a contact surface 524 which is in contact with the stem valve 14.

During an operation the first cam surface 511 is in contact with the second cam surface 521 of the second cam profile 52. Both cam profiles 51, 52 are provided with at least one depression and/or elevation. The first cam profile 51 here includes two depressions and two elevations. The second cam profile 52 here includes also two depressions and two elevations which correspond in geometry with the depressions and elevations of the first cam profile 51. The second cam profile 52 is arranged in mirror symmetry with the first cam profile 51. In operation a rotation of the first cam profile 51 will result in an axial movement of the second cam profile 52. In case that an elevation of the first cam profile 51 is positioned opposite a depression of the second cam profile 52, the actuator member is positioned away from the container body 10 and the stem valve is closed. The first and second cam profile are in that mode positioned close to each other. In case that an elevation of the first cam profile 51 is opposite an elevation of the second cam profile 52, the first and second cam profile will be spaced from each other. In that mode, the actuator member is positioned towards the container body 10 and will exert a depressing force on the stem valve 14. The hollow stem will be depressed and the stem valve 14 is opened.

The actuator member of the actuating mechanism here further comprises a stopper 31. The stopper 31 cooperates with a stopper seat 32 to define a drip stop valve. The drip stop valve is in particular advantageous for an aerosol container filled with a foamable soap. The aerosol container 9 as shown in FIG. 2 is advantageous for an aerosol container 9 which is filled with a product which has to be sprayed.

Figure 5C:
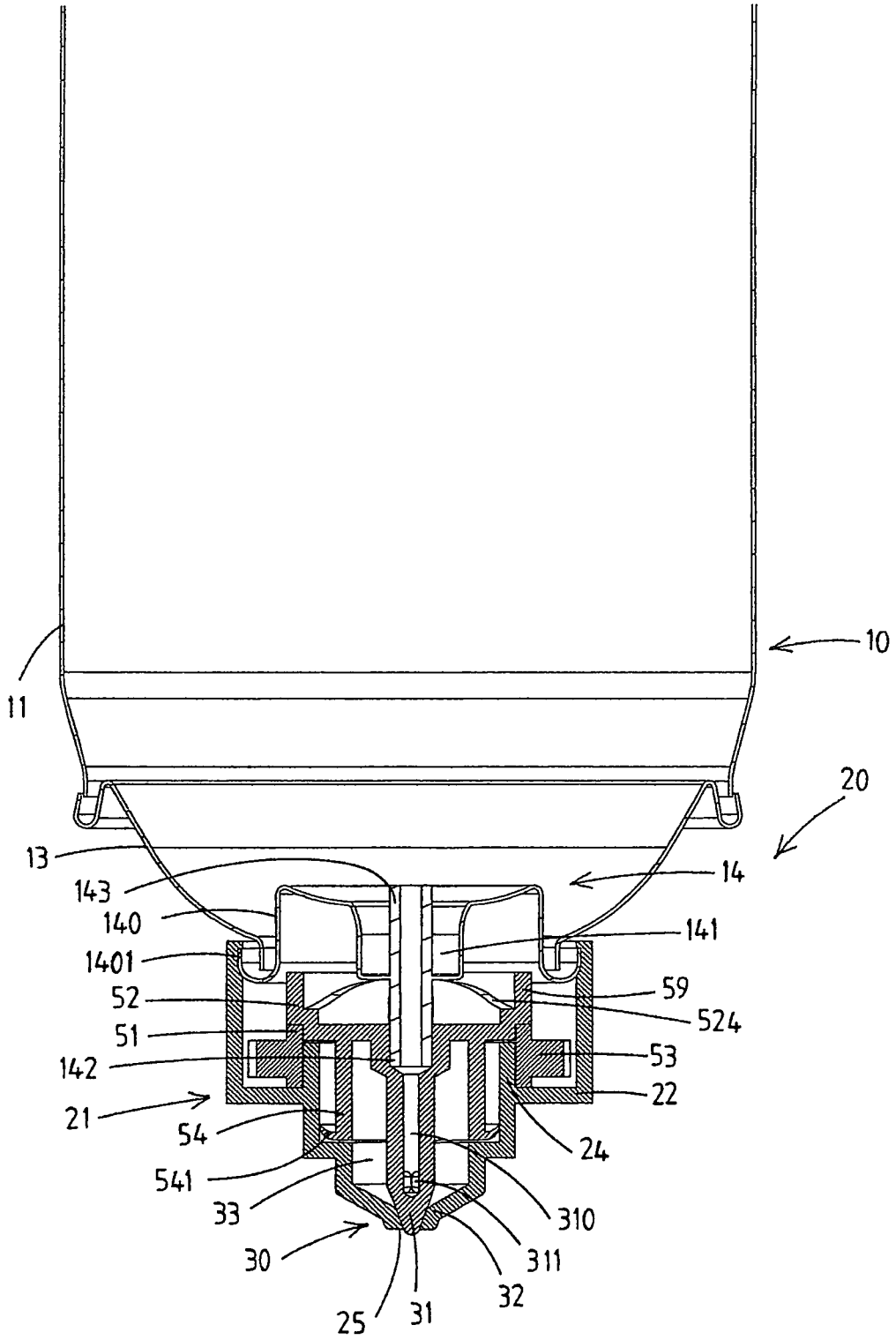
FIG. 5C shows a cross sectional view of the aerosol container as shown in FIG. 5A.

FIG. 5C further elucidates this drip stop 30 by showing the aerosol container in a cross sectional view.

FIG. 5C shows the container body 10 and the spout 20. The spout 20 is fixed to the top end 13 of the container body 10. The top end 13 is provided with a stem valve 14. The stem valve 14 here comprises an undulating base plate 140. The hollow stem 141 is fixed to the base plate 140. The hollow stem 141 has a first open end 142 outside the container body 10 and a second open end 143 inside the container body 10. A membrane (not shown) is arranged inside the container body 10 to shut off the hollow stem 141 at the second open end inside the container body. The hollow stem 141 can be depressed in axial direction to deform the membrane and to open the second open end 143 of the hollow stem 141. The base plate 140 has an outer folded edge 1401. The spout 20 here is fixed to the outer folded edge of 1401 of the base plate 140 as is preferred. Once the spout 20 is connected to the container body 10, it is hardly possible to remove the spout 20 from the container body 10 without damaging one of the parts. The spout 20 is robustly fastened to the container body 10 to prevent improper use of the aerosol container. An attempt to remove the spout 20 from the container body 10 will probably damage the spout housing 21, such that the spout housing 21 cannot be used again. Herewith, the aerosol container including the container body 10 and spout 20 is a disposable item.

FIG. 5C shows the drip stop valve 30 in further detail. The stopper 31 here is needle shaped and connected to the actuator member 59. The stopper 31 has a passage 310 which is in fluid communication with the follow stem 141. The passage 310 extends in axial direction away from the hollow stem 141. The passage way 310 of the stopper 31 has at a distal end at least one through bore 311 which ends up in a drip chamber 33. A product which is exhausted from the container body 10 will pass through the passage 310 via the bore 311 to the drip chamber 33. An outlet opening 25 will be opened when the stopper 31 is moved away from the stopper seat 32. The product which has arrived in the drip chamber 33 will be discharged from the open outlet opening 25. The drip stop valve is in particular suitable to be used with soap, in particular hand soap, more in particular foaming hand soap. After use of the dispenser machine 1, the product will remain in the drip chamber 33. The return of the stopper 31 onto the stopper seat 32 will prevent that the remaining product drips through the outlet opening 25 out of the aerosol container. Herewith the aerosol container may remain clean during its life time. The drip stop valve may further prevent hardening of the product and a clog up of the outlet opening 25 or the hollow stem.

The drip chamber 33 is sealed from other inner spaces of the spout 20. A piston rod 54 having a piston seal 541 is provided to seal the drip chamber 33. The piston rod 54 is integrated with the actuator member 59. The actuator member 59 can be manufactured by injection moulding. The actuator member 59 may be out of one piece comprising the contact surface 524 to depress the stem valve 14, the stopper 31 of the drip stop valve 30 and the sealed piston rod 54 to separate the drip chamber 33 from the remaining spaces and components of the spout.

Figure 6A:
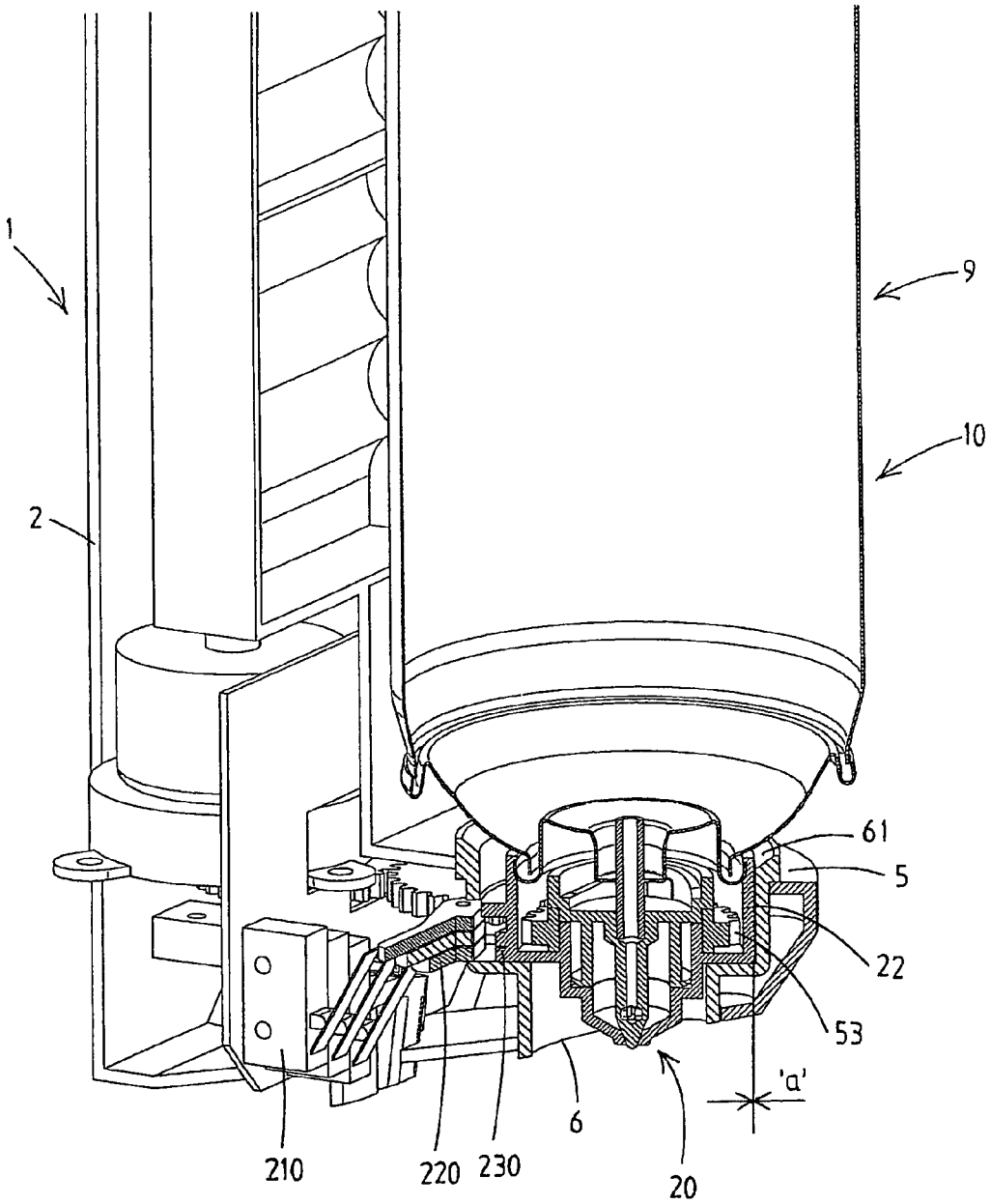
FIG. 6A shows a partly cross sectional view of an aerosol dispenser machine comprising an aerosol container according to the invention.

FIG. 6A shows a perspective view which is partially in cross section of the dispenser machine loaded with an aerosol container 9. The aerosol container is positioned in a non-operational mode. The top head with spout 20 is inserted in the receiving chamber 61. The outer wall 22 is positioned adjacent to an inner wall of the receiving chamber 61. No play "a" is present in this non-operation mode.

Figure 6B:
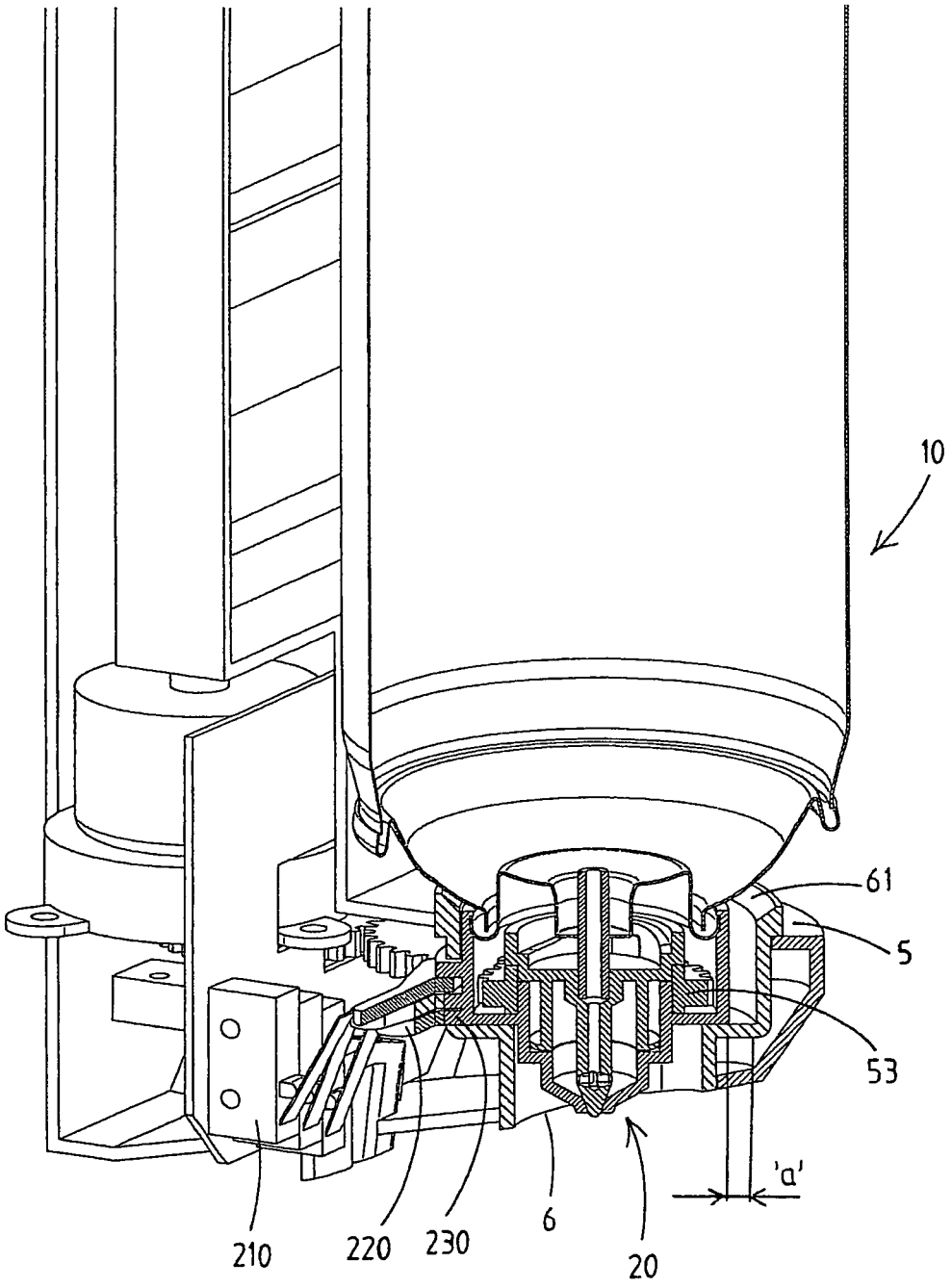
FIG. 6B shows the aerosol dispenser machine as shown in FIG. 6A in an operational mode.

FIG. 6B shows a corresponding view including a difference in that the aerosol container is now positioned in an operation mode. The aerosol container 9 is in comparison with the non-operational mode as shown in FIG. 3A radially moved to the frame 2. The aerosol container 9 is radially moved to the backside of the dispenser machine 1. The radial movement serves to close a drive system. The drive system is further illustrated in FIG. 7A and FIG. 7B.

As shown in FIGS. 6A and 6B the spout housing 21 comprises at the outer wall 22 at least one protrusion 230. The protrusion 230 is indicative for the type of product which is contained in the aerosol container 9. The protrusion 230 is a technical feature which allows the dispenser machine 1 to recognize what kind of product is loaded in the dispenser machine. The protrusion 230 cooperates with at least one microswitch 210 as shown, three microswitches 210 are arranged on the frame 2 of the dispenser machine 1. The protrusion 230 may switch a microswitch 210 when the aerosol container 9 is positioned in the operational mode. The protrusion 230 is switching the microswitch 210 via at least one lever 220 in the operational mode. The illustrated three microswitches 210 provide a possibility to recognize different types of product in an aerosol container 9. The dispenser machine 1 may be programmed to adjust a dosage independence of the type of product loaded.

Figure 7A:
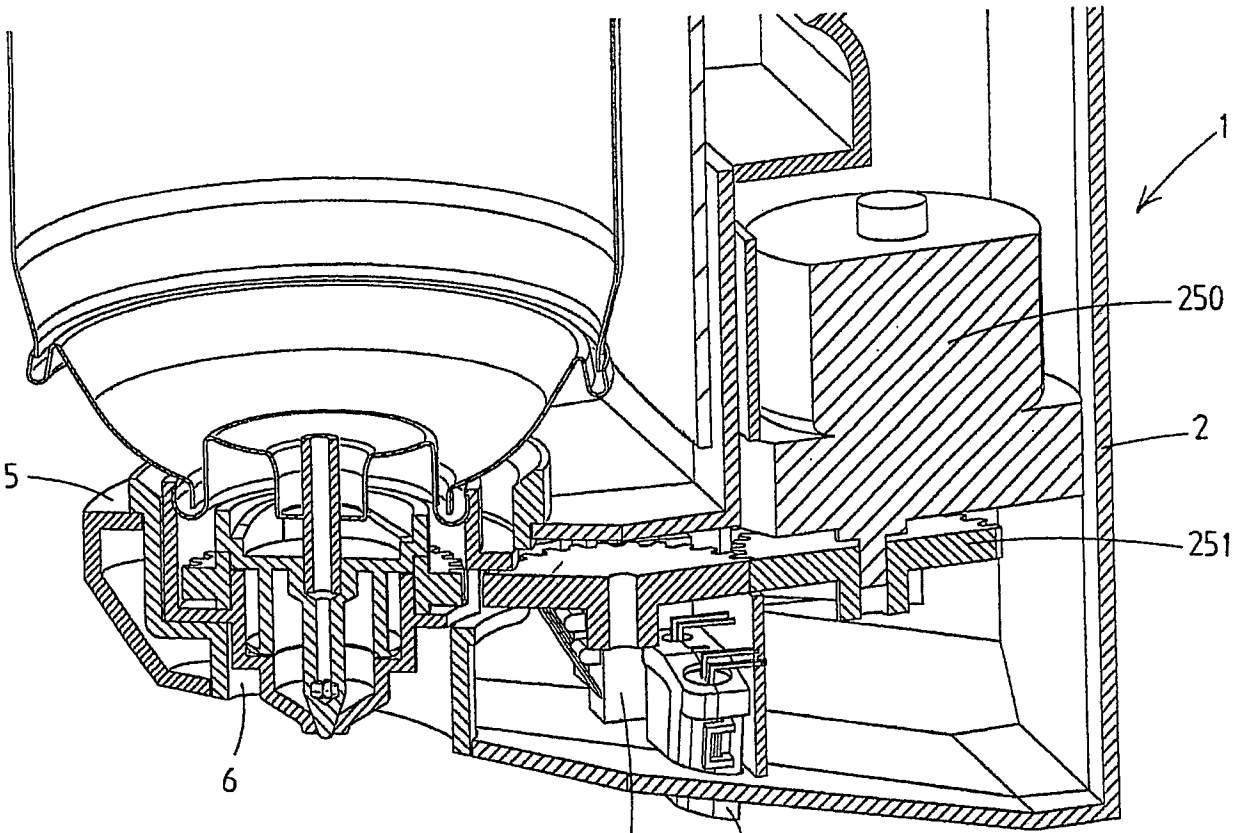
FIG. 7A shows a cross sectional view of a drive system of the aerosol dispenser machine in a loading mode.
Figure 7B:
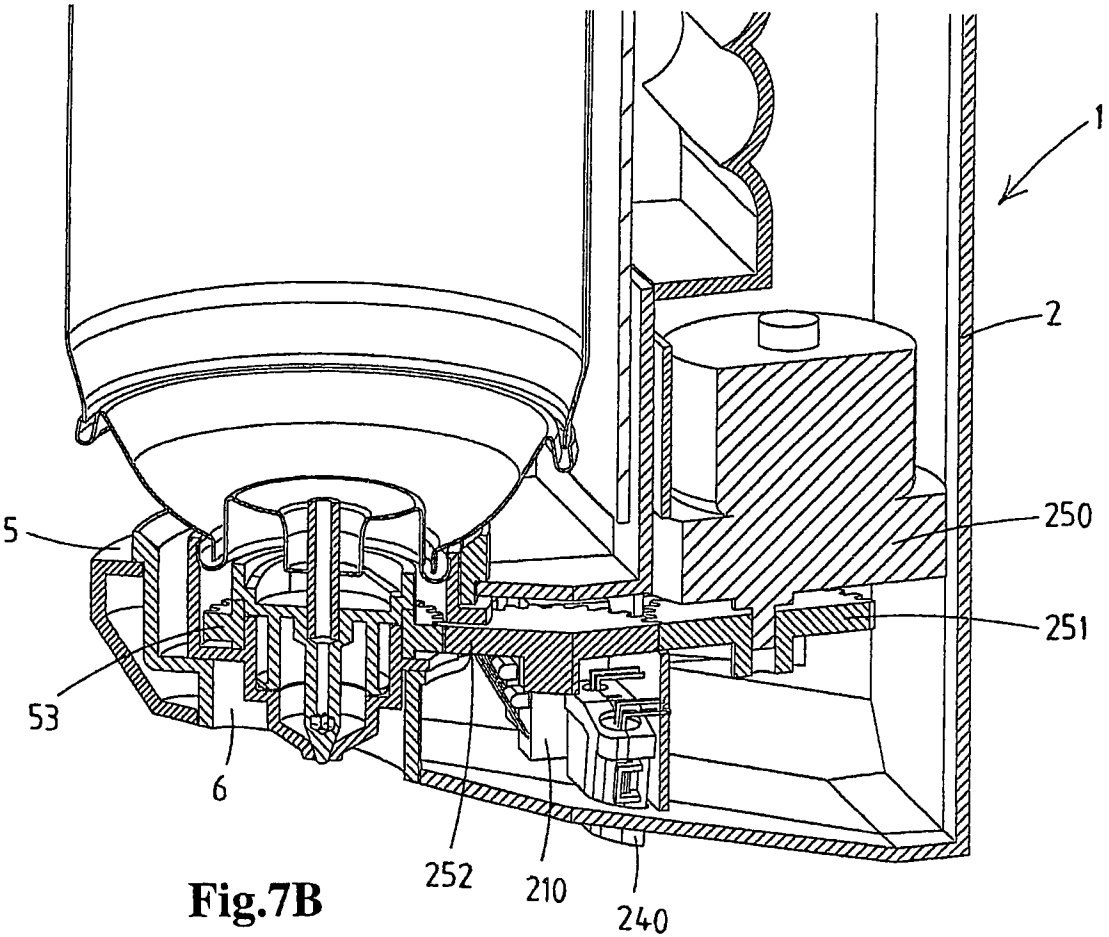
FIG. 7B shows in a cross sectional view the aerosol drive system as shown in FIG. 5A in an operational mode.

FIGS. 7A and 7B illustrate a drive system to operate the inner actuating mechanism of the aerosol container 9 in more detail. FIG. 7A shows a cross sectional view of the dispenser machine 1 in a non-operational mode. FIG. 7B shows the dispenser machine 1 in the operational mode, wherein gear wheels of the drive system are in engagement with each other.

The drive system of the dispenser machine 1 is controlled by a control unit. Detecting means 240 provide the control unit with a detecting signal. The detecting signal may be generated when a persons hand is situated under the discharge opening 6. The control unit activates an electric motor 250. An output shaft of the motor 250 is connected to a first gear wheel 251, which engages to a second gear wheel 252. The first and second gear wheel 251, 252 define a first stage of transmission of the drive system. The second gear wheel engages with the primary gear wheel 53 of the actuating mechanism 50 inside the spout housing 21. The second gear wheel 252 engages the gear wheel 53 via the access opening 23. A rotational movement of the second gear wheel 252 is transferred to the rotatable gear wheel 53 which will operate the stem valve to an open position.

Although the invention has been disclosed with reference to particular embodiments, from reading this description those of scale in the art may appreciate changes and modification that may be possible from a technical point of view but which do not depart from the scope of the invention as described above and claimed hereafter. It will be understood by those of scale in the art that various changes may be made and equivalents may be substituted for elements thereof without departing from the scope of the invention. Modifications may be made to adapt a particular situation or material to the teachings of the invention without departing from the essential scope thereof.

In a variant of the illustrated embodiments of the aerosol container a combination of features may be made wherein e.g. the drip stop valve which is shown in FIG. 5C is incorporated in the design of the aerosol container as shown in FIG. 4A.

The illustrated embodiment has a container body with a valve of a male type, in which the valve includes a hollow stem. In a variant, it is also possible to apply a valve of a female type, in which the actuator member of the spout is adapted to fit on the female valve. The actuator member may include the hollow stem.

Therefore, it is intended that the invention not be limited to the particular embodiments disclosed in the above detailed description, but that the invention will include all embodiments falling within the scope of the appended claims.

We claim:

1. Aerosol container for use in a dispenser machine, wherein the aerosol container comprises a container body for containing a product and a propellant, wherein the container body has a bottom end, a cylindrical wall which defines an axial direction, and a top end, wherein the top end comprises an opening provided with a valve for discharging product from the container body, which valve is actuable to an open position and is normally closed in a closed position, wherein the aerosol container further comprises a spout having a spout housing which is fixed to the container body, wherein the spout housing circumferences the valve, said spout housing has an outer wall and wherein the spout has an outlet opening which is in fluid communication with the valve for discharging product from the aerosol container, wherein the spout comprises an inner actuating mechanism for actuating the valve to said open position, said mechanism comprises an actuator member to act on the valve to act the valve to said open position, wherein the actuator member comprises a cam profile which is connected to the valve such that an axial movement of the cam profile opens or closes the valve, the cam profile connected to the spout housing by at least one lock member to prevent a rotation of the cam profile with respect to the spout housing and to permit an axial movement of the cam profile with respect to the spout housing, wherein the at least one lock member has a ring body which circumferences the cam profile, wherein the ring body is fixed to the outer wall at two opposite positioned outer fixation points and fixed to the actuator member by two opposite positioned inner fixation points.

2. Aerosol container according to claim 1, wherein the cam profile has an at least two fold rotational symmetry.

3. Aerosol container according to claim 1, wherein the cam profile comprises a cam surface which has at least two depressions and at least two elevations in axial direction.

4. Aerosol container according to claim 1, wherein the cam profile comprises a cylindrical body including a central axis which extends in the axial direction of the container body, wherein the at least two elevations are positioned opposite each other with respect to the central axis through the cylindrical body.

5. Aerosol container according to claim 1, wherein the outlet opening comprises a drip stop valve for stop dripping of product from the container after a discharge.

6. Aerosol container according to claim 5, wherein the drip stop valve comprises a stopper and a stopper seat, wherein the stopper seat is connected to the outer wall and wherein the stopper is connected to the axially movable actuator member.

7. Aerosol container according to claim 1, wherein the aerosol container comprises at least one orientation means to orient the aerosol container in one rotational position over the axial direction with respect to the dispenser machine.

8. Aerosol container according to claim 1, wherein the aerosol container has at least one recognizing means at an outer surface which corresponds with a type of a contained product in the container body.

9. Aerosol container for use in a dispenser machine, wherein the aerosol container comprises a container body for containing a product and a propellant, wherein the container body has a bottom end, a cylindrical wall which defines an axial direction, and a top end, wherein the top end comprises an opening provided with a valve for discharging product from the container body, which valve is actuable to an open position and is normally closed in a closed position, wherein the aerosol container further comprises a spout having a spout housing which is fixed to the container body, wherein the spout housing circumferences the valve, said spout housing has an outer wall and wherein the spout has an outlet opening which is in fluid communication with the valve for discharging product from the aerosol container, wherein the spout comprises an inner actuating mechanism for actuating the valve to said open position, said mechanism comprises an actuator member to act on the valve to act the valve to said open position, wherein the actuator member comprises a cam profile which is connected to the valve such that an axial movement of the cam profile opens or closes the valve, the cam profile connected to the spout housing by at least one lock member to prevent a rotation of the cam profile with respect to the spout housing and to permit an axial movement of the cam profile with respect to the spout housing, wherein the actuating mechanism comprises a primary drive member to be driven by the dispenser machine and wherein the primary drive member is rotatable mounted in the spout housing, wherein the outer wall includes an access opening to access the actuating mechanism and to drive the primary drive member from outside the outer wall by a drive component of the dispenser machine.

10. Aerosol container according to claim 9, wherein the access opening is covered by a removable cover.

11. Aerosol container according to claim 9, wherein said primary drive member is a rotatable gear wheel and wherein the spout housing houses a pair of a first and second cam profile, said first cam profile is connected to said gear wheel to rotate together with said gear wheel, said second cam profile is connected to the actuator member and linear movable in axial direction positioned opposite the first cam profile such that a relative rotation of the first cam profile with respect to the second cam profile causes the second cam profile to move in the axial direction.

12. Aerosol container according to claim 11, wherein the gear wheel and the pair of cam profiles are concentrically positioned with respect to said hollow stem of the stem valve.

13. Dispenser machine for use in combination with an aerosol container, wherein the aerosol container comprises a container body for containing a product and a propellant, wherein the container body has a bottom end, a cylindrical wall which defines an axial direction, and a top end, wherein the top end comprises an opening provided with a stem valve, wherein the stem valve includes a hollow stem for discharging product from the container body, which stem valve is actuable to an open position and is normally closed in a closed position, wherein the aerosol container further comprises a spout having a spout housing which is fixed to the container body, wherein the spout housing circumferences the hollow stem, said spout housing has an outer wall and wherein the spout has an outlet opening which is in fluid communication with the hollow stem for discharging product from the aerosol container, wherein the spout comprises an inner actuating mechanism for actuating the stem valve to said open position, said mechanism comprises an actuator member to act on the stem valve to act the stem valve to said open position, wherein the actuator member comprises a cam profile which is connected to the stem valve such that an axial movement of the cam profile causes an axial movement of the hollow stem to open or close the stem valve, wherein the cam profile is connected to the spout housing by at least one lock member to prevent a rotation of the cam profile with respect to the spout housing and to permit an axial movement of the cam profile with respect to the spout housing, wherein the at least one lock member has a ring body which circumferences the cam profile, wherein the ring body is fixed to the outer wall at two opposite positioned outer fixation points and fixed to the actuator member by two opposite positioned inner fixation points, wherein the dispenser machine has receiving means for receiving the aerosol container which receiving means position the aerosol container at a predefined position with respect to a frame of the dispenser machine, wherein the dispenser machine comprises a transmission for actuating the actuator member by the dispenser machine, wherein the transmission forms together with the actuating mechanism a drive system, which drive system comprises a gear wheel as a primary drive member and a pair of a first and second cam profile, said first cam profile is connected to said gear wheel to rotate together with said gear wheel, said second cam profile is connected to the actuator member and linear movable in axial direction positioned opposite the first cam profile such that a relative rotation of the first cam profile with respect to the second cam profile causes the second cam profile to move in the axial direction.

14. Dispenser machine according to claim 13, wherein said gear wheel is connected to the frame and positioned in the receiving means.

15. Dispenser machine according to claim 13, wherein said gear wheel is housed in the spout housing of the aerosol container and drivable by a drive component which is connected to a motor of the dispenser machine, wherein the drive component is insertable into an access opening of the aerosol container, wherein said insertable drive component is beared and positioned adjacent the receiving means.

16. System comprising an aerosol container for use in a dispenser machine, wherein the aerosol container comprises a container body for containing a product and a propellant, wherein the container body has a bottom end, a cylindrical wall which defines an axial direction, and a top end, wherein the top end comprises an opening provided with a valve for discharging product from the container body, which valve is actuable to an open position and is normally closed in a closed position, wherein the aerosol container further comprises a spout having a spout housing which is fixed to the container body, wherein the spout housing circumferences the valve, said spout housing has an outer wall and wherein the spout has an outlet opening which is in fluid communication with the valve for discharging product from the aerosol container, wherein the spout comprises an inner actuating mechanism for actuating the valve to said open position, said mechanism comprises an actuator member to act on the valve to act the valve to said open position, wherein the actuator member comprises a cam profile which is connected to the valve such that an axial movement of the cam profile opens or closes the valve, the cam profile connected to the spout housing by at least one lock member to prevent a rotation of the cam profile with respect to the spout housing and to permit an axial movement of the cam profile with respect to the spout housing, wherein the at least one lock member has a ring body which circumferences the cam profile, wherein the ring body is fixed to the outer wall at two opposite positioned outer fixation points and fixed to the actuator member by two opposite positioned inner fixation points; and a dispenser machine wherein the dispenser machine has receiving means for receiving the aerosol container which receiving means position the aerosol container at a predefined position with respect to a frame of the dispenser machine, wherein the dispenser machine comprises a transmission for actuating the actuator member by the dispenser machine, wherein the transmission forms together with the actuating mechanism a drive system, which drive system comprises a gear wheel as a primary drive member and a pair of a first and second cam profile, said first cam profile is connected to said gear wheel to rotate together with said gear wheel, said second cam profile is connected to the actuator member and linear movable in axial direction positioned opposite the first cam profile such that a relative rotation of the first cam profile with respect to the second cam profile causes the second cam profile to move in the axial direction.

17. System according to claim 16, wherein the system comprises a drive system which includes a transmission which is positioned at the dispenser machine and an actuating mechanism which is positioned at the aerosol container.

18. System according to claim 17, wherein the actuating mechanism comprises an actuator member to act on a stem valve of a container body to act the stem valve to an open position, wherein the actuator member comprises a cam profile which is connected to the stem valve such that an axial movement of the cam profile causes an axial movement of the hollow stem to open or close the stem valve, wherein the cam profile is connected to the spout housing by at least one lock member to prevent a rotation of the cam profile with respect to the spout housing and to permit an axial movement of the cam profile with respect to the spout housing.

19. System according to claim 17, wherein the actuating mechanism comprises, a primary drive member to be driven by the dispenser machine and wherein the primary drive member is rotatable mounted inside the spout housing, wherein the outer wall includes an access opening to access the actuating mechanism and to drive the primary drive member from outside the outer wall by a drive component of the dispenser machine.

20. System according to claim 19, wherein said primary drive member comprises a rotatable gear wheel as primary drive member and wherein the spout housing houses a pair of a first and second cam profile, said first cam profile is connected to said gear wheel to rotate together with said gear wheel, said second cam profile is connected to the actuator member and linear movable in axial direction positioned opposite the first cam profile such that a relative rotation of the first cam profile with respect to the second cam profile causes the second cam profile to move in the axial direction.

* * * * *